US009627822B2

(12) United States Patent
Hori

(10) Patent No.: US 9,627,822 B2
(45) Date of Patent: Apr. 18, 2017

(54) CONNECTOR

(71) Applicant: IRISO ELECTRONICS CO., LTD., Kanagawa (JP)

(72) Inventor: Kiichi Hori, Kanagawa (JP)

( * ) Notice: Subject to any disclaimer, the term of this patent is extended or adjusted under 35 U.S.C. 154(b) by 0 days.

(21) Appl. No.: 15/098,423

(22) Filed: Apr. 14, 2016

(65) Prior Publication Data

US 2016/0308311 A1 Oct. 20, 2016

(30) Foreign Application Priority Data

Apr. 17, 2015 (JP) ..... 2015-085471

(51) Int. Cl.

| | |
|---|---|
| ***H01R 13/703*** | (2006.01) |
| ***H01R 12/70*** | (2011.01) |
| ***H01R 12/73*** | (2011.01) |
| ***H01R 12/91*** | (2011.01) |

(52) U.S. Cl.

CPC ..... *H01R 13/7032* (2013.01); *H01R 12/7005* (2013.01); *H01R 12/737* (2013.01); *H01R 12/91* (2013.01)

(58) Field of Classification Search

CPC ..... H01R 13/703; H01R 13/7031; H01R 13/7032; H01R 13/7033; H01R 13/7034; H01R 13/7035; H01R 13/7036

See application file for complete search history.

(56) References Cited

U.S. PATENT DOCUMENTS

| | | | | |
|---|---|---|---|---|
| 4,106,841 | A | 8/1978 | Vladic | |
| 5,470,243 | A | 11/1995 | Bendorf | |
| 6,244,880 | B1 * | 6/2001 | Fukase | H01R 13/62911 439/157 |

(Continued)

FOREIGN PATENT DOCUMENTS

| | | | |
|---|---|---|---|
| EP | 0665612 | A2 | 8/1995 |
| EP | 0852413 | A1 | 7/1998 |

(Continued)

OTHER PUBLICATIONS

European Search Report for EP Patent App. No. 16165220.1 (Aug. 22, 2016).

*Primary Examiner* — Ross Gushi
(74) *Attorney, Agent, or Firm* — Cermak Nakajima & McGowan LLP; Tomoko Nakajima

(57) ABSTRACT

In a plug connector including a first connection terminal and a second connection terminal which come into conductive contact with a socket connector and a relay terminal which comes into contact with the first connection terminal and the second connection terminal, the relay terminal includes a switch contact piece which comes into contact with the first connection terminal. Further, the switch contact piece includes a short circuit contact which comes into contact with the first connection terminal and an open contact which is displaced when coming into contact with the socket connector. The short circuit contact is displaced with displacement of the open contact in a direction away from the first connection terminal so as to switch the short circuit connection between the first connection terminal and the second connection terminal and the conductive connection between the first connection terminal and the socket connector in a reliable manner.

6 Claims, 32 Drawing Sheets

(56) References Cited

U.S. PATENT DOCUMENTS

| | | | | |
|---|---|---|---|---|
| 7,275,946 | B2 * | 10/2007 | Ohtaka | H01R 13/7032 200/51.1 |
| 2008/0261425 | A1 | 10/2008 | Nakamura | |
| 2016/0190750 | A1 | 6/2016 | Shinmi | |

FOREIGN PATENT DOCUMENTS

| | | | |
|---|---|---|---|
| JP | 53-133790 | A | 11/1978 |
| JP | 63-106083 | U | 7/1988 |
| JP | 2008-293938 | A | 12/2008 |
| JP | 2014-212086 | A | 11/2014 |
| WO | WO2015/027729 | A1 | 3/2015 |

* cited by examiner

CONNECTOR

BACKGROUND OF THE INVENTION

1. Field of the Invention

The present invention relates to a connector that forms different circuits in a fitted state and a non-fitted state of a connection target.

2. Description of the Related Art

An electric device having a substrate may be extended by connecting a connection target such as an extension board to a connector fixed on the substrate. Usually, the connection target is inserted and removed into and from the connector at each time when the extension board is inserted and removed or is replaced with a different extension board. Further, the connector includes a plurality of terminals arranged to face each other such that the terminals are in conductive contact with each other so as to form a shorted closed circuit in a non-fitted state in which the connection target is not connected to the connector. When the connection target is fitted, the terminals are pressed in the direction in which the terminals are separated from each other, thereby allowing the closed circuit to be opened. Furthermore, the connection target can be in conductive contact with the terminals so as to form another circuit, thereby adding a new function (For example, see Japanese Unexamined Patent Application Publication No. 53-133790).

In the above connector, the contact for opening the closed circuit which is displaced when pressed by the connection target and the contact for connection to the connection target are disposed on the same terminal. When the connection target is fitted, the contact for connection is displaced as the contact for opening moves. Accordingly, when the connection target is repeatedly inserted and removed, the terminals may be plastically deformed and cause difficulty in conductive contact between the contact for connection and the connection target. Furthermore, the contact for connection also serves as a contact for conductive connection between the terminals in a non-fitted state. Accordingly, if the terminals are plastically deformed in a direction in which the terminals are separated from each other, a problem arises that the contacts for connection may fail to contact with each other in a non-fitted state of the connection target, thereby failing to form the above closed circuit.

SUMMARY OF THE INVENTION

The present invention has been made to overcome the above problem. It is an object of the present invention to provide a connector that reliably switches between conductive connection of the terminals in a non-fitted state of a connection target and conductive connection of the terminal and the connection target in a fitted state of the connection target.

The above object of the present invention is achieved as follows.

According to an aspect of the invention, a connector including a first connection terminal and a second connection terminal which come into conductive contact with a connection target; a relay terminal which comes into contact with the first connection terminal and the second connection terminal; and a housing having an insertion port for the connection target, wherein the relay terminal includes a switch contact piece which comes into contact with the first connection terminal, and the switch contact piece includes a short circuit contact which comes into contact with the first connection terminal and an open contact which is displaced when coming into contact with the connection target inserted in the housing so that the short circuit contact is displaced with displacement of the open contact in a direction away from the first connection terminal to release the short circuit connection.

The connector of the present invention includes the relay terminal which comes into contact with the first connection terminal and the second connection terminal, and the relay terminal includes the switch contact piece which comes into contact with the first connection terminal. The first connection terminal and the second connection terminal (terminal for conductive connection) serve as a signal connection terminal, and the relay terminal serves as a short circuit/open terminal separately from those members. Since the relay terminal allows for a short circuit connection between the first connection terminal and the second connection terminal without interposing the connection target, a closed circuit can be formed in the non-fitted state of the connection target without elastically deforming the first connection terminal and the second connection terminal, which are signal connection terminals, for a short circuit connection. Further, the switch contact piece includes the short circuit contact which comes into contact with the first connection terminal and the open contact which is displaced when coming into contact with the connection target. When the short circuit contact is displaced with displacement of the open contact in a direction away from the first connection terminal, the short circuit connection can be released. Accordingly, by inserting the connection target into the housing so as to be in contact with the open contact, it is possible to form a short circuit connection can be formed by the first connection terminal, the relay terminal and the second connection terminal without elastically deforming the first connection terminal itself, and to release the short circuit connection. As a result, it is possible to reliably switch the short circuit connection in the non-fitted state of the connection target and the conductive connection between the first connection terminal and the connection target even if the connection target is repeatedly inserted and removed.

Further, if the first connection terminal and the second connection terminal include the above open contact and the short circuit contact, those connection terminals have a complicated structure, leading to decrease in the manufacturing accuracy. On the other hand, according to the connector of the present invention, since the relay terminal having the open contact and the short circuit contact is provided separately from the connection terminals, it is possible to simplify the structure of the first connection terminal and the second connection terminal. Accordingly, the manufacturing accuracy of the connection terminals can be improved.

In the above aspect of the invention, the relay terminal includes a short circuit contact piece which comes into contact with the second connection terminal.

Since the relay terminal includes not only the switch contact piece which comes into contact with the first connection terminal, but also the short circuit contact piece which comes into contact with the second connection terminal, the contact pieces that form the conductive paths for short circuit connection can be collectively disposed on the relay terminal so as to simplify the terminal configuration of the second connection terminal.

In the above aspect of the invention, the open contact is located close to the insertion port of the housing than the first connection terminal so that the open contact and the first connection terminal come into contact with the connection target in this order.

With this configuration, the connection target first comes into contact with the open contact, and the short circuit contact is separated from the first connection terminal, and then, the connection target comes into conductive contact with the first connection terminal. Accordingly, the connection target can be in conductive contact with the first connection terminal after the closed circuit is ensured to be opened.

In the above aspect of the invention, the short circuit contact and the open contact can be formed at the same position in a width direction of the switch contact piece.

With this configuration, the relay terminal can be prevented from increasing in size in the width direction of the switch contact piece.

In the above aspect of the invention, the switch contact piece is formed as a single elastic piece, the open contact is disposed on a distal end side of the switch contact piece, and the short circuit contact can be formed between the distal end side and the proximal end side.

Since the open contact and the short circuit contact are formed on the same elastic piece, those contacts can be displaced in a coordinated manner by movement of a single elastic piece. Accordingly, the short circuit connection between the short circuit contact and the first connection terminal and the release of the connection can be switched in a reliable manner. Further, since the open contact and the short circuit contact are formed on the same elastic piece, the entire relay terminal can be decreased in size.

In the above aspect of the invention, the switch may include a bending section which serves as a displacement support of the open contact and the short circuit contact on the proximal end side.

With this configuration, by utilizing the principle of lever, the open contact disposed on the distal end side of the switch contact piece can be displaced with a small amount of force, and the contact pressure to the first connection terminal of the short circuit contact disposed on the proximal end side can be increased. Accordingly, since the force required to bring the connection target into contact with the open contact for displacement can be decreased, an operator can easily perform a fitting operation of the connection target.

In the above aspect of the invention, the relay terminal includes a fixed base for the housing, and the short circuit contact piece can be formed by cutting out a metal piece which forms the fixed base.

With this configuration, the entire relay terminal can be decreased in size compared with the case, for example, where the short circuit contact piece extends outward from the fixed base.

In the above aspect of the invention, the housing can house the relay terminal and include a guide pole that guides insertion of the connection target into the housing.

With this configuration, the entire housing can be decreased in size compared with the case where the guide portion and the portion for housing the relay terminal are separately formed.

According to the connector of the present invention, since the relay terminal that switches the short circuit connection and the open connection is provided separately from the first connection terminal and the second connection terminal, it is possible to reliably switch the short circuit connection between the first connection terminal and the second connection terminal in the non-fitted state of the connection target and the conductive connection between the first connection terminal and the connection target in the fitted state. Accordingly, the short circuit connection can be reliably performed in the non-fitted state, thereby preventing a malfunction of the electric device. Further, in the fitted state, the conductive connection can be reliably performed and the short circuit connection is released so as to perform the signal connection in a reliable manner.

DESCRIPTION OF THE PREFERRED EMBODIMENTS

Figure 1:
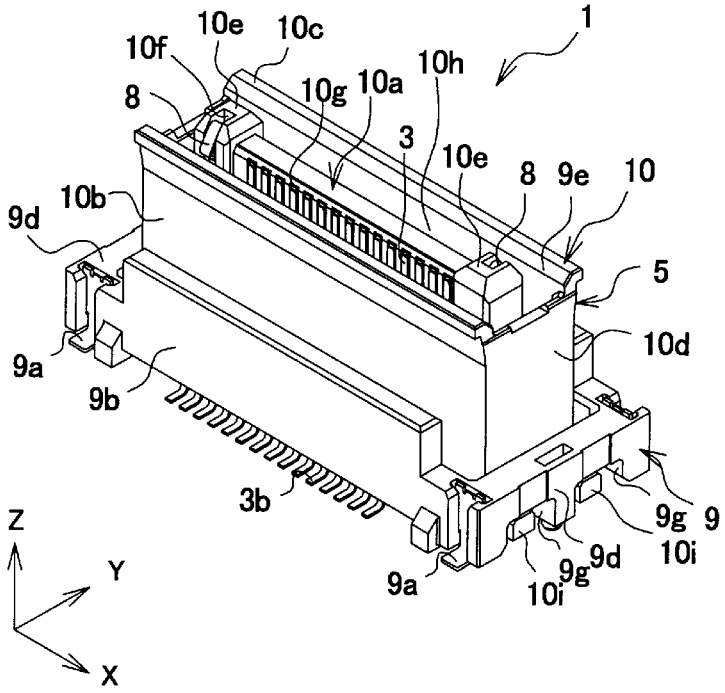
FIG. 1 is a perspective view which shows a plug connector according to an embodiment.

With reference to the drawings, a preferred embodiment of a connector of the present invention will be described below. A "connector" in the present embodiment refers to a plug connector 1 that is mounted on an electric device, which is not shown in the figure, and includes plug terminals 3 soldered to a substrate P1. A "connection target" refers to a socket connector 2 which includes socket terminals 4A, 4B soldered to a substrate P2. When the socket connector 2 and the plug connector 1 are fitted to each other, the socket terminals 4A, 4B, the plug terminals 3, and the first and second connection terminals 7A, 7B are in conductive contact with each other, thereby establishing a conductive connection between the substrate P1 and the substrate P2. The socket connector 2 is used for a purpose of extending the functions of an electric device to which the plug connector 1 is mounted. Further, the plug connector 1 and the socket connector 2 are connected at an angle so that the plate surfaces of the substrate P1 and the substrate P2 are perpendicular to each other when they are in a fitted state.

In the following description, a width direction of the plug connector 1 (longitudinal direction) is hereinafter referred to as an X direction, a front-back direction (short-side direction) is hereinafter referred to as a Y direction, and a height direction (up-down direction) is hereinafter referred to as a Z direction. Further, in the height direction Z, a side on which the plug connector 1 is provided is hereinafter referred to as a "lower side" and a side on which the socket connector 2 is provided is hereinafter referred to as an "upper side." In the front-back direction Y, a side on which a fitting section 11A used for fitting of the socket connector 2 and the plug connector 1 is located is hereinafter referred to as a "front side" and a side on which a leg 11B is fixed to a substrate P2 is hereinafter referred to as a "rear side". However, a mounting method and usage of the plug connector 1 and the socket connector 2 are not limited thereto. Since a left side view of the plug connector 1 is symmetrical to the right side view, illustration thereof is omitted. Further, since a left side view of the socket connector 2 is also symmetrical to the right side view, illustration thereof is omitted.

Embodiments [FIG. 1 to FIG. 32]:

[Plug Connector]

The plug connector 1 is a floating connector which includes a plug housing 5, the plug terminals 3, the first and second connection terminals 7A, 7B, and a relay terminal 8.

[Plug Housing]

As shown in FIGS. 1 to 5, the plug housing 5 includes a stationary housing 9 and a movable housing 10.

[Stationary Housing]

The stationary housing 9 is made of an insulative resin, and includes a metal fitting 9*a* for soldering to the substrate P1. In this embodiment, the stationary housing 9 has four metal fittings 9*a*. Further, the stationary housing 9 includes a front wall 9*b*, a rear wall 9*c*, side walls 9*d*, 9*d*, and a movable gap 9*i* defined by the front wall 9*b*, the rear wall 9*c* and the side walls 9*d*, 9*d*.

The front wall 9*b* and the rear wall 9*c* are provided with the plate surfaces extending in the width direction X. Further, the front wall 9*b* and the rear wall 9*c* include a terminal housing 9*f* that houses the plug terminal 3 and a movable section 3*d* of one of the first and second connection terminals 7A, 7B. A plurality of terminal housings 9*f* are provided in the width direction X.

The side walls 9*d* are each provided on each end of the stationary housing 9 in the width direction X so as to connect the front wall 9*b* and the rear wall 9*c*. Further, the side walls 9*d* are provided with the plate surface extending in the front-back direction Y. Two engagement recesses 9*g* are formed on the underside of the side walls 9*d* so as to be arranged in the front-back direction Y. In the engagement recess 9*g*, an engagement section 10*i* of the movable housing 10, which is described below, is provided.

[Movable Housing]

The movable housing 10 is made of an insulative resin and is held to be movable relative to the stationary housing 9. The movable housing 10 is relatively movable to the stationary housing 9 in the movable gap 9*i* of the stationary housing 9. Further, the movable housing 10 includes a housing main body 10A and a catch section 10B to the stationary housing 9.

The housing main body 10A includes a front wall 10*b*, a rear wall 10*c*, and side walls 10*d*, 10*d*, and a fitting wall 10*a*.

The front wall 10*b* and the rear wall 10*c* are provided with the plate surfaces extending in the width direction X. The side walls 10*d* are provided so as to connect the front wall 10*b* and the rear wall 10*c* and extends in the front-back direction Y.

The fitting wall 10*a* has a plate surface which extends in the width direction X and the height direction Z and is disposed in a space defined by the front wall 10*b*, the rear wall 10*c* and the side walls 10*d*, 10*d*. Further, the fitting wall 10*a* includes guide poles 10*e* and terminal grooves 10*g*.

Figure 2:
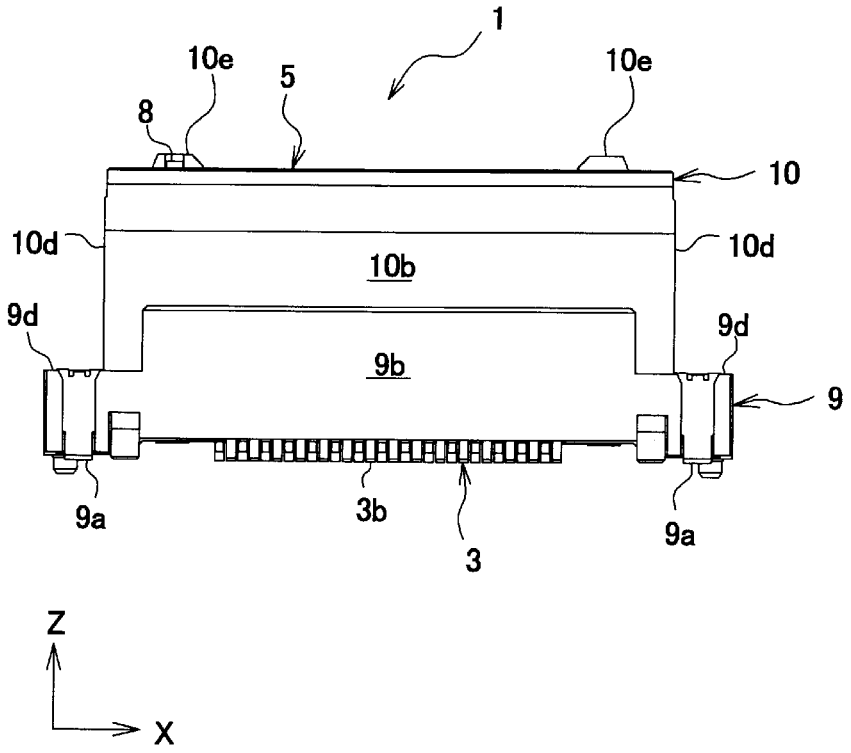
FIG. 2 is a front view which shows the plug connector of FIG. 1.
Figure 3:
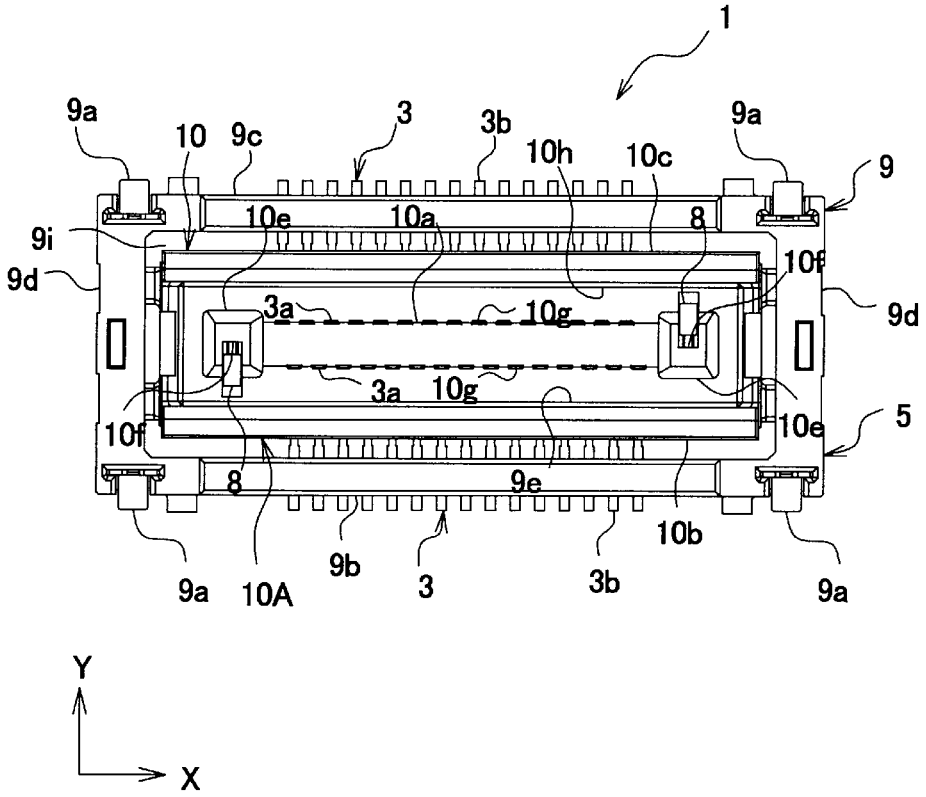
FIG. 3 is a plan view which shows the plug connector of FIG. 1.
Figure 4:
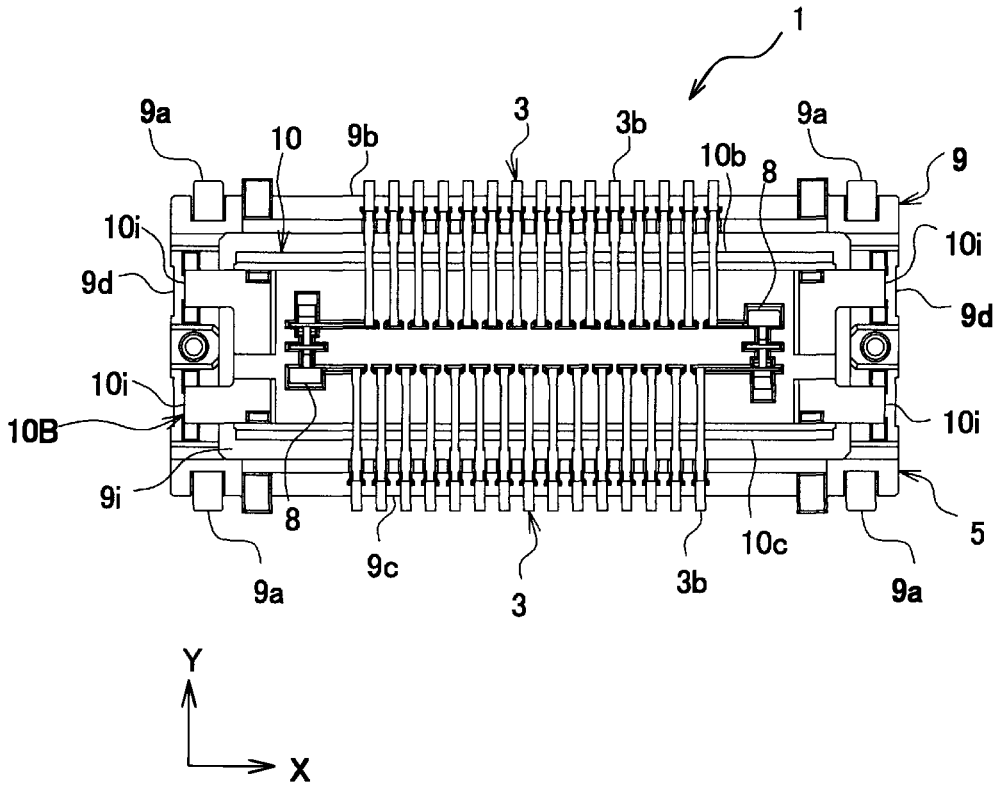
FIG. 4 is a bottom view which shows the plug connector of FIG. 1.
Figure 5:
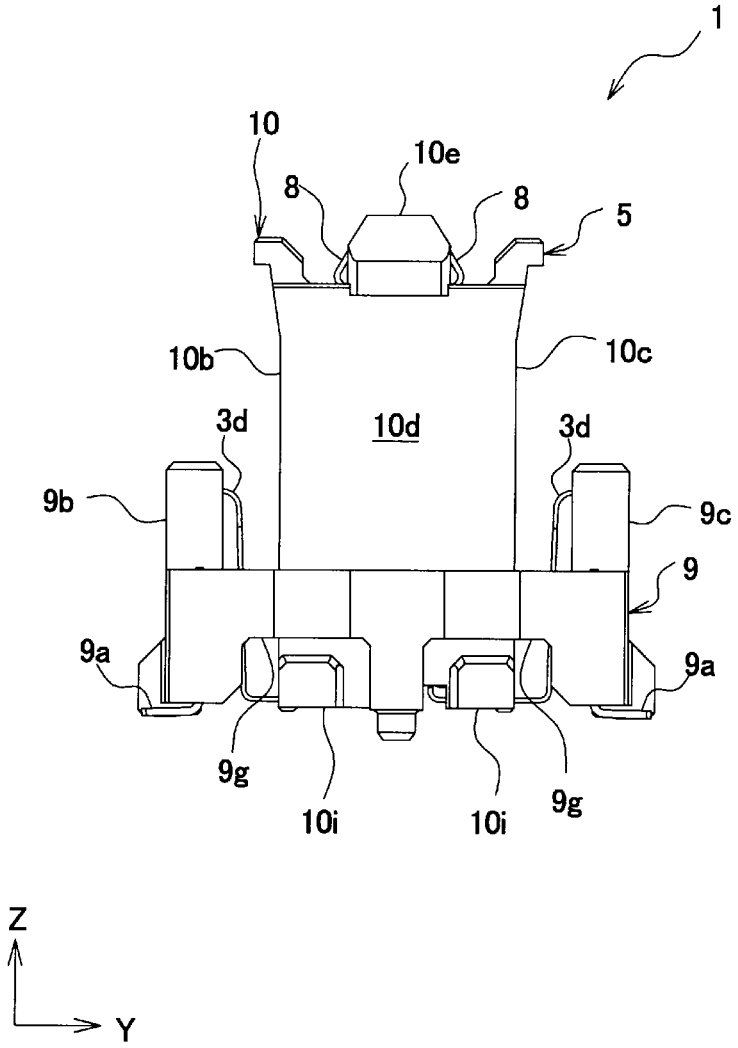
FIG. 5 is a right side view which shows the plug connector of FIG. 1.
Figure 26:
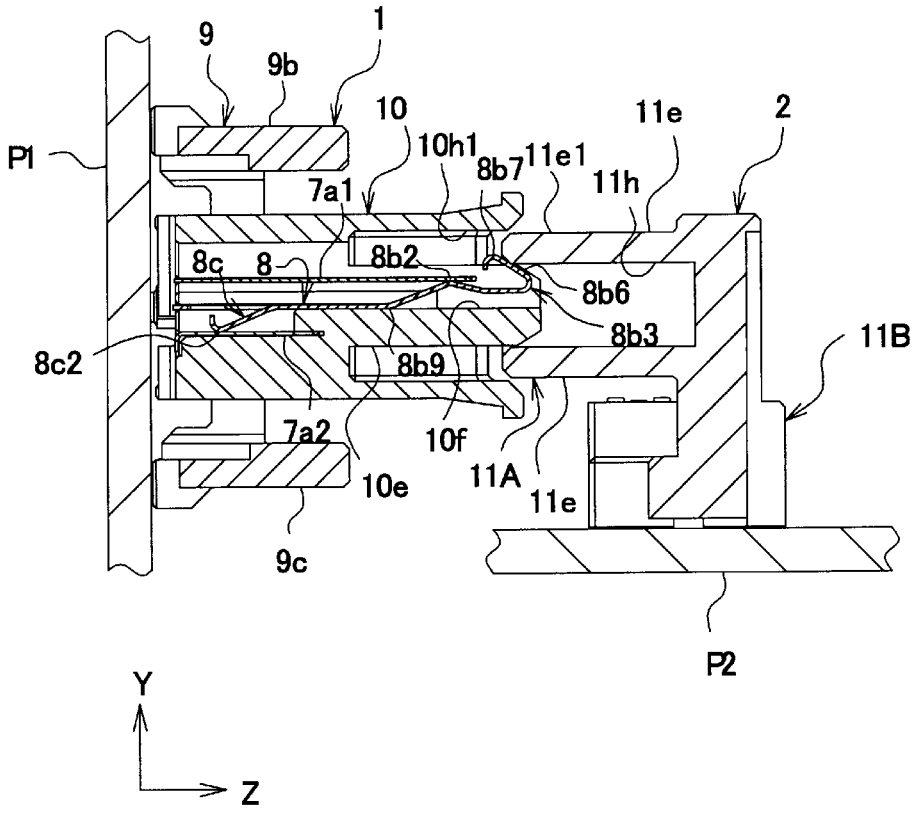
FIG. 26 is a cross sectional view which shows the plug connector and the socket connector in a non-fitted state taken along the line XXVI-XXVI of FIG. 25.
Figure 27:
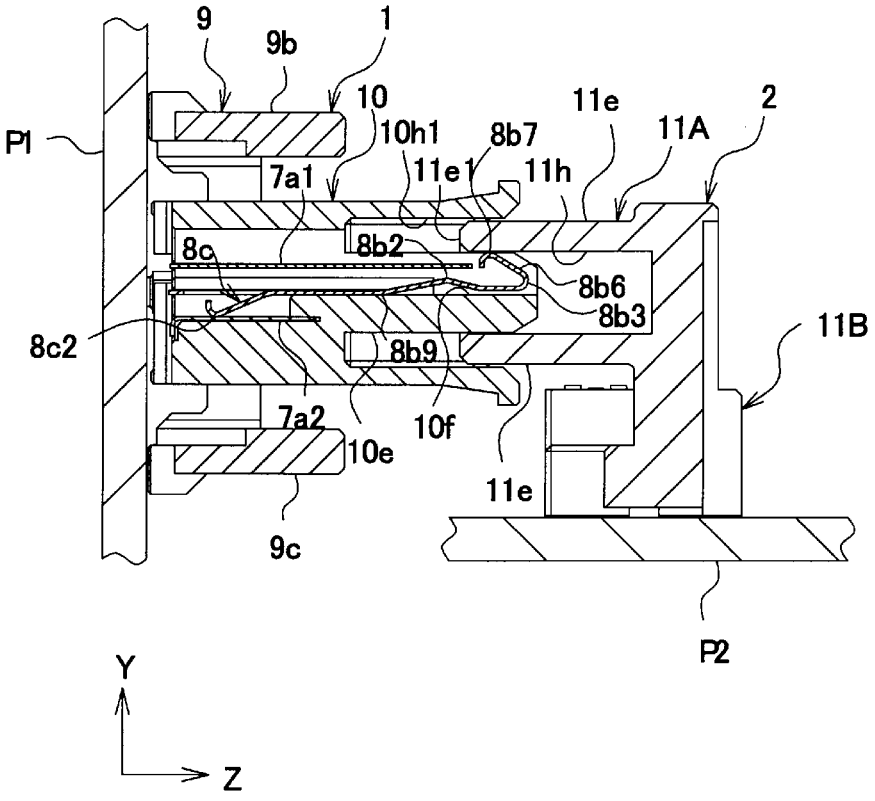
FIG. 27 is a cross sectional view corresponding to FIG. 26 which shows the plug connector and the socket connector in a half-fitted state.
Figure 28:
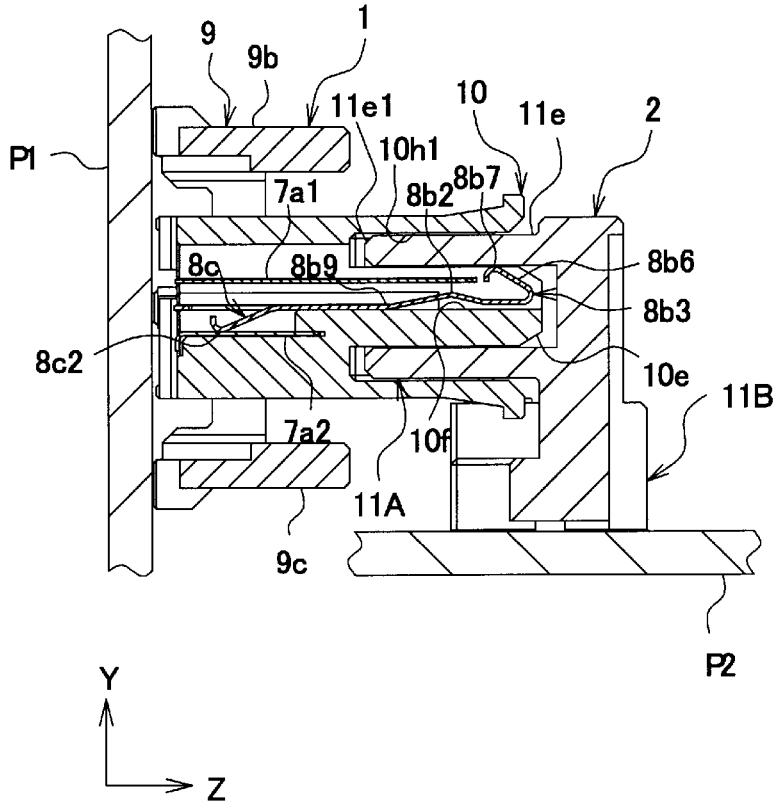
FIG. 28 is a cross sectional view corresponding to FIG. 26 which shows the plug connector and the socket connector in a fitted state.

The guide poles 10*e* each have a substantially quadrangular prism shape and are arranged on both ends of the fitting wall 10*a* in the width direction X. Each guide poles 10*e* is formed to be large in the front-back direction Y and the height direction Z compared with the other parts of the fitting wall 10*a*. As shown in FIG. 2, the distal ends of the guide poles 10*e* protrude upward with respect to the front wall 10*b*, the rear wall 10*c*, and the side walls 10*d* of the movable housing 10. On one end of the guide pole 10*e* in the front-back direction Y, a relay terminal housing groove 10*f* is formed to extend in the height direction Z so that the relay terminal 8 is disposed in the relay terminal housing groove 10*f* (FIGS. 26 to 28). The relay terminal housing grooves 10*f* on one of two guide poles 10*e* of the plug connector 1 is open to the front side, and the relay terminal housing grooves 10*f* on the other of two guide poles 10*e* of the plug connector 1 is open to the rear side. Further, the relay terminal housing grooves 10*f* serve to fix switch sections 7*a*1, 7*a*2 of the first and second connection terminals 7A, 7B therein. The switch section 7*a*2 of the second connection terminal 7B is in conductive contact with a second short circuit contact 8*c*2 of the relay terminal 8 in a lower part of the relay terminal housing groove 10*f*. On the other hand, the switch section 7*a*1 of the first connection terminal 7A is in conductive contact with a first short circuit contact 8*b*2 of the relay terminal 8 in an upper part of the relay terminal housing groove 10*f*.

The terminal grooves 10*g* are formed on the plate surface of the fitting wall 10*a* and extend in the height direction Z so that a plug contact sections 3*a* of the plug terminal 3 are fixed in the terminal grooves 10*g*. The terminal grooves 10*g* are formed on both the front side and the rear side of the fitting wall 10*a*. The terminal grooves 10*g* on the front side of the fitting wall 10*a* and the terminal grooves 10*g* on the rear side of the fitting wall 10*a* are offset in the width direction X. Accordingly, the terminal grooves 10*g* are arranged in a zigzag pattern in plan view.

A plug-side fitting chamber 10*h* is provided between the fitting wall 10*a* and the guide poles 10*e*, the front wall 10*b*, the rear wall 10*c* and the side walls 10*d*. The fitting section 11A of the socket connector 2 is inserted in the plug-side fitting chamber 10*h* so that the socket terminals 4A, 4B are in conductive contact with the plug terminals 3, and the first and second connection terminals 7A, 7B.

The catch section 10B includes the engagement section 10*i* that extends in the width direction X in the lower part of the side wall 10*d*. Two engagement sections 10*i* are arranged in the front-back direction Y so as to be housed in the engagement recesses 9*g*.

[Plug Terminal, First and Second Connection Terminals]

Figure 10:
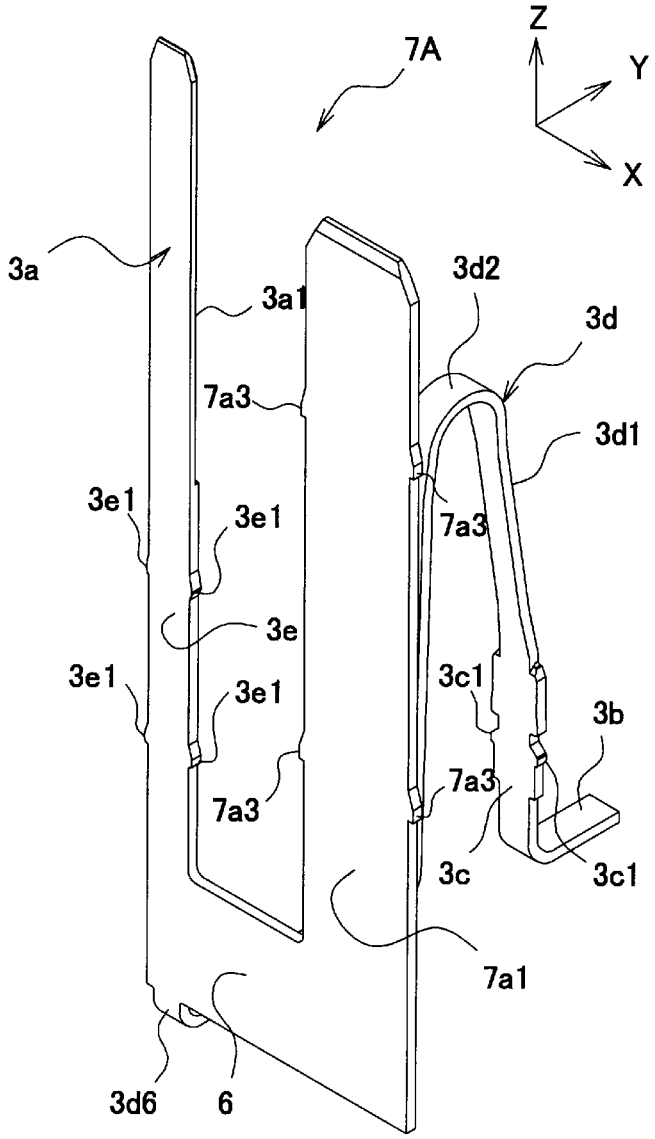
FIG. 10 is a front-side perspective view which shows a first connection terminal according to an embodiment.
Figure 11:
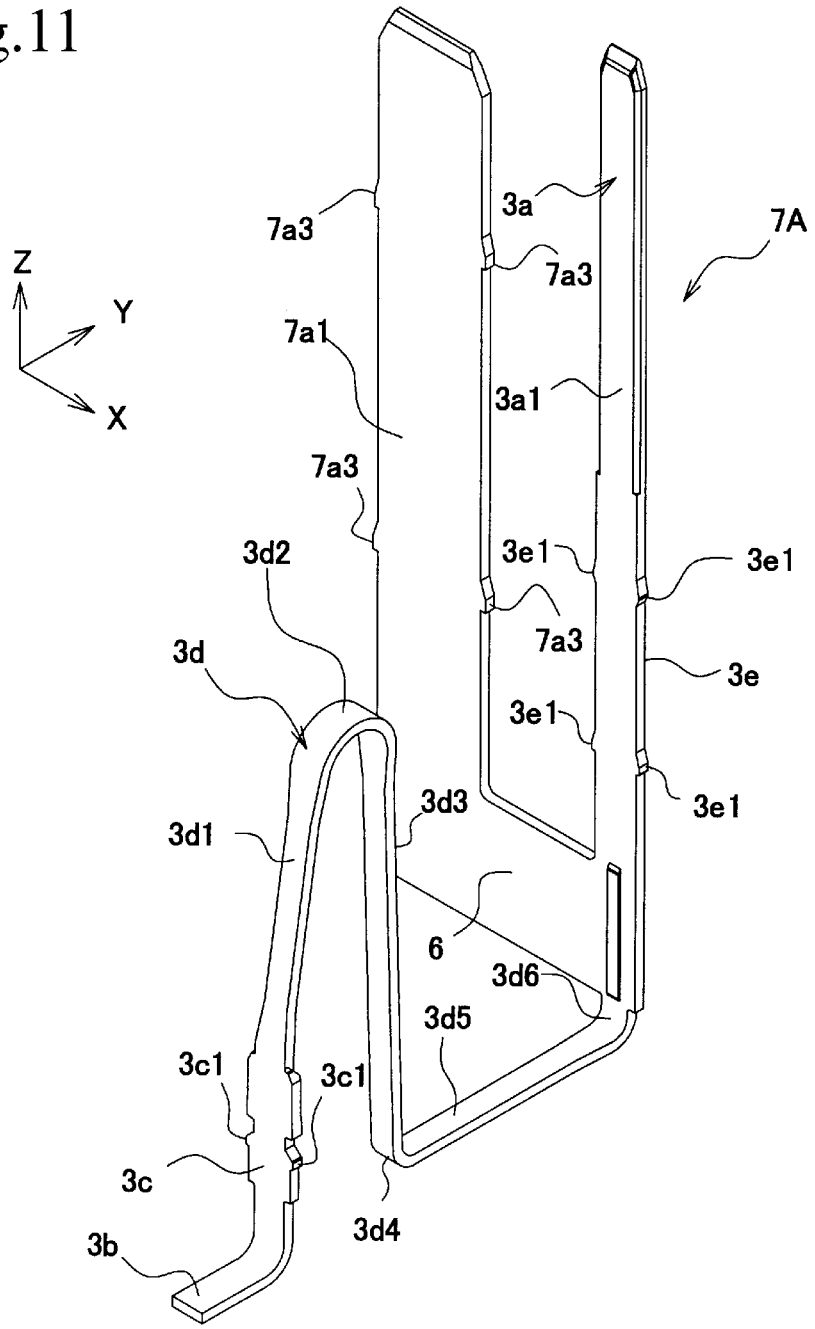
FIG. 11 is a rear-side perspective view which shows the first connection terminal of FIG. 10.
Figure 12:
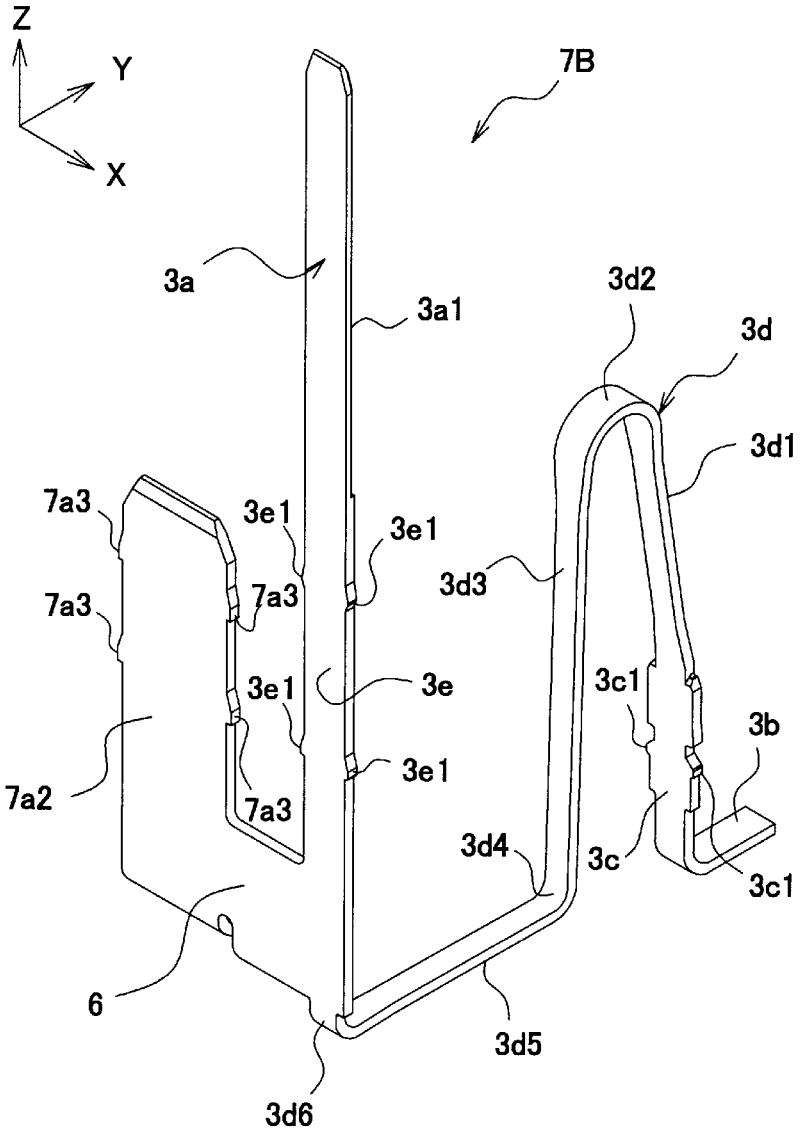
FIG. 12 is a front-side perspective view which shows a second connection terminal according to an embodiment.

The plug terminal 3 is formed by bending a metal piece formed by punching a metal plate. Further, as shown in FIGS. 10 and 11, the plug terminal 3 includes a substrate connecting section 3*b*, a housing fixation unit 3*c*, a movable section 3*d*, a base 3*e* and a plug contact section 3*a*. The first connection terminal 7A further includes the switch section 7*a*1 in addition to the same configuration as that of the plug terminal 3. Further, the second connection terminal 7B further includes the switch section 7*a*2 in addition to the same configuration as that of the plug terminal 3.

The substrate connecting section 3*b* is disposed on the lower end of the plug terminal 3 and has a flat substantially rectangular plate surface. The substrate connecting section 3*b* is soldered to the substrate P1 while the substantially rectangular plate surface is in contact with the substrate surface of the substrate P1.

The housing fixation unit 3*c* has a substantially rectangular plate surface. Engagement projections 3*c*1 are provided on both ends of the housing fixation unit 3*c* in the width direction X. When the plug terminal 3 is press fitted in the terminal housing 9*f* disposed in the stationary housing 9 of the plug housing 5 and the engagement projections 3*c*1 of the plug terminal 3 is fitted on the inner wall of the terminal housing 9*f*, the plug terminal 3 can be fixed to the stationary housing 9.

The movable section 3*d* is provided as a metal piece of a narrow shaft which extends from the upper end of the housing fixation unit 3*c*. The movable section 3*d* includes a first extending section 3*d*1, a first bending section 3*d*2, a second extending section 3*d*3, a second bending section 3*d*4, a third extending section 3*d*5 and a third bending section 3*d*6.

The first extending section 3*d*1 is connected to the upper end of the housing fixation unit 3*c* and extends upward. The upper portion of the first extending section 3*d*1 is slightly bent in a contact direction with the socket terminals 4A, 4B of the socket connector 2 in the fitted state and extends inclined to the height direction Z. The first bending section 3*d*2 is connected to the upper end of the first extending section 3*d*1 and is turned back in a substantially U shape from the upper side to the lower side. The second extending section 3*d*3 is connected to the lower end of the first bending section 3*d*2 and extends downward. The second bending section 3*d*4 is connected to the lower end of the second extending section 3*d*3 and is bent in a substantially L shape. The third extending section 3*d*5 is connected to the second bending section 3*d*4 and extends in the front-back direction Y. The third bending section 3*d*6 is connected to the third extending section 3*d*5 and is bent in a substantially L shape.

The base 3*e* is formed as a metal piece of a narrow shaft which is connected to the end of the third bending section 3*d*6 and extends upward in the height direction Z. The base 3*e* has a length in the width direction X slightly larger than that of the third bending section 3*d*6. Engagement projections 3*e*1 are provided on both ends of the base 3*e* in the width direction X so as to be fixed in the terminal grooves 10*g* of the plug housing 5. For the first and second connection terminals 7A, 7B, a connection plate 6 connected to the switch sections 7*a*1, 7*a*2, which will be described below, is connected to the side end of the base 3*e*.

The plug contact section 3*a* is provided as a metal plate that is connected to the upper end of the base 3*e* and inserted in the terminal groove 10*g* on the fitting wall 10*a* of the plug housing 5 to extend in the width direction X and the height direction Z. The plate surface that faces the socket terminals 4A, 4B in a fitted state is a terminal surface 3*a*1 and comes into contact with a terminal section 4*e* of the socket terminals 4A, 4B. The terminal grooves 10*g* are disposed on both the front side and the rear side of the fitting wall 10*a* so that the plug contact sections 3*a*, 3*a* are housed in each of the terminal grooves 10*g* on the front side and the terminal grooves 10*g* on the rear side. Further, the plug contact sections 3*a*, 3*a* are arranged in a zigzag pattern in plan view with the fitting wall 10*a* therebetween.

When the engagement projections 3*e*1 are fitted on the inner wall of the terminal groove 10*g* (not shown in the figure), the plug contact sections 3*a* as well as the base 3*e* are fixed in the terminal grooves 10*g*. Accordingly, in the fitted state and the non-fitted state the socket connector 2, the plug contact section 3*a* is not displaced or deformed to the terminal groove 10*g*. Therefore, a problem such as plastic deformation of the plug contact section 3*a* does not occur.

The switch sections 7*a*1, 7*a*2 are provided for the first and second connection terminals 7A, 7B, respectively, and are formed as a metal plate having a substantially rectangular shape connected to a connection plate 6 which is connected to a plate end of the base 3*e* and extend in the height direction Z. Engagement projections 7*a*3 which are fixed onto the inner wall (not shown in the figure) of the relay terminal housing groove 10*f* of the plug housing 5 are provided on both ends in the width direction X on the upper side of the switch sections 7*a*1, 7*a*2. The switch sections 7*a*1, 7*a*2 are fixed in the relay terminal housing grooves 10*f*, 10*f* of the guide poles 10*e*, 10*e* by means of the engagement projections 3*c*1.

The first connection terminal 7A is different from the second connection terminal 7B in the length of the connection section 6. That is, the length of the connection section 6 in the first connection terminal 7A is longer than the length of the connection section 6 in the second connection terminal 7B. When the first connection terminal 7A and the second connection terminal 7B are housed in the relay terminal housing groove 10*f* of the plug housing 5, the switch plates 7*a*, 7*a* of the first connection terminal 7A and the second connection terminal 7B are placed at the same position in the width direction X and face each other via the relay terminal 8. However, as described above, since the connection sections 6, 6 of the first and second connection terminals 7A, 7B are different in length, the plug contact sections 3*a*, 3*a* are placed at different positions in the width direction X. Accordingly, the plug contact section 3*a* on the front side with respect to the fitting wall 10*a* and the plug contact section 3*a* on the rear side with respect to the fitting wall 10*a* are arranged in a zigzag pattern in the width direction X.

Figure 13:
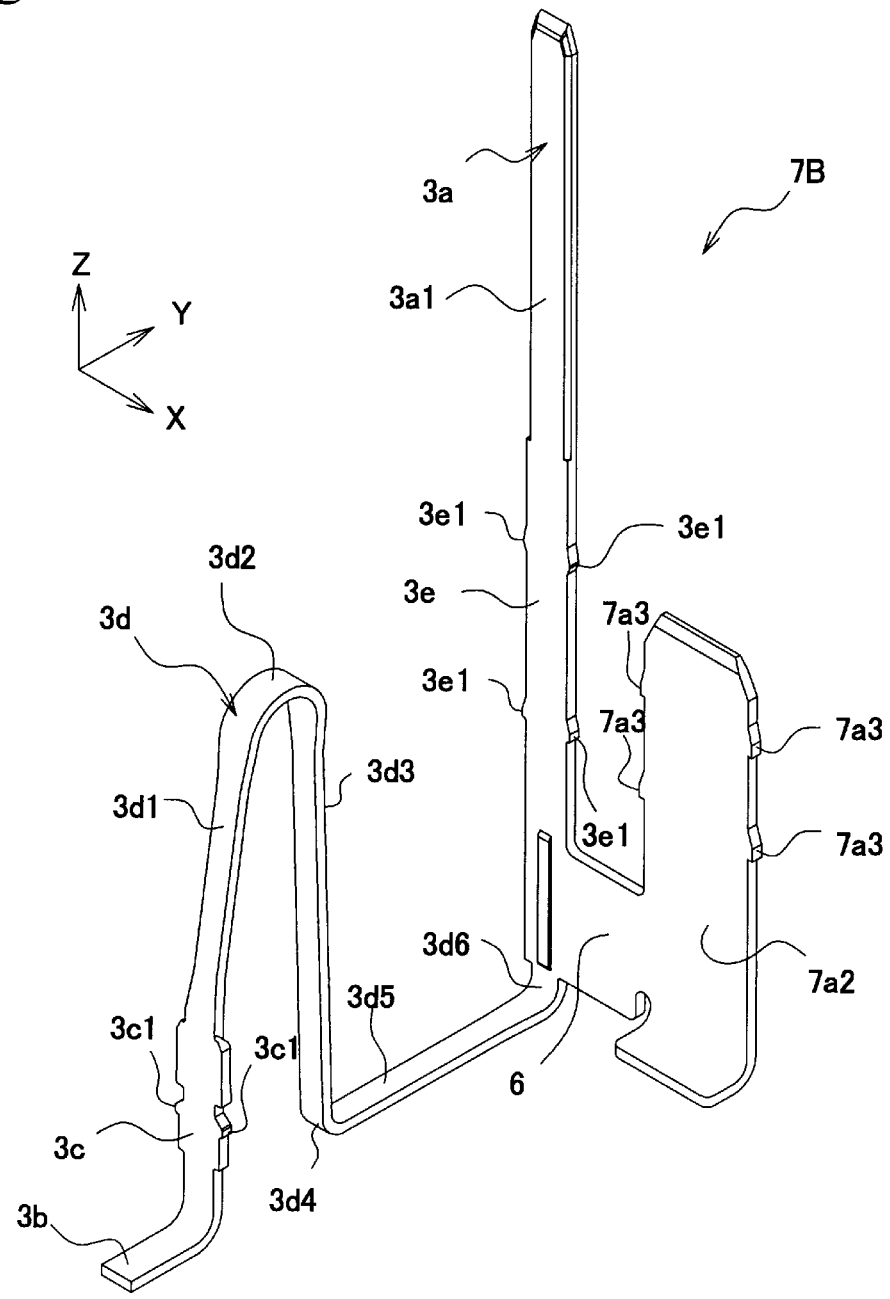
FIG. 13 is a front-side perspective view which shows the second connection terminal of FIG. 12.
Figure 14:
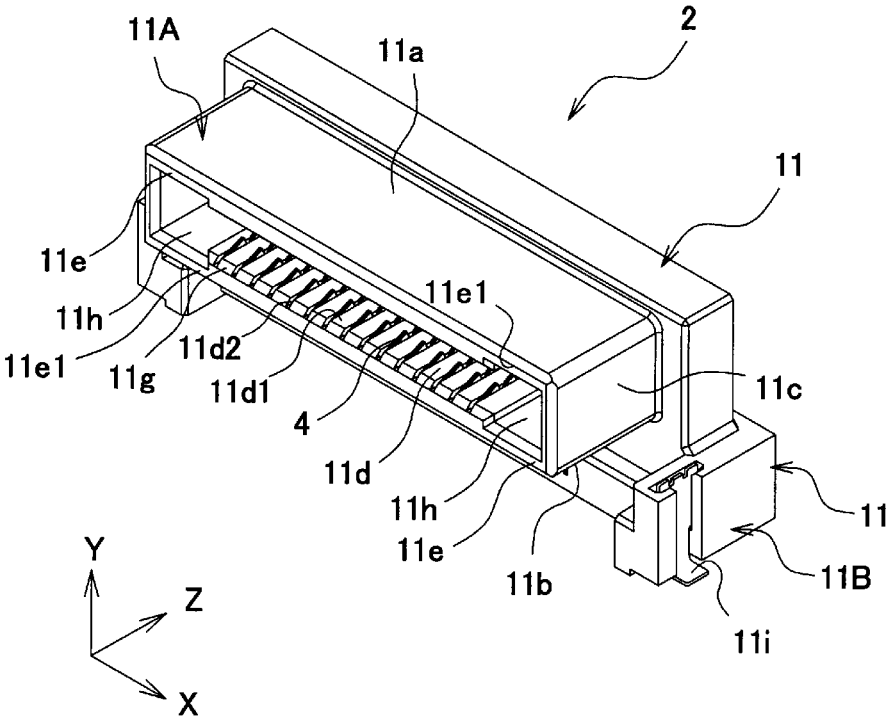
FIG. 14 is a front-side perspective view which shows a socket connector according to an embodiment.
Figure 15:
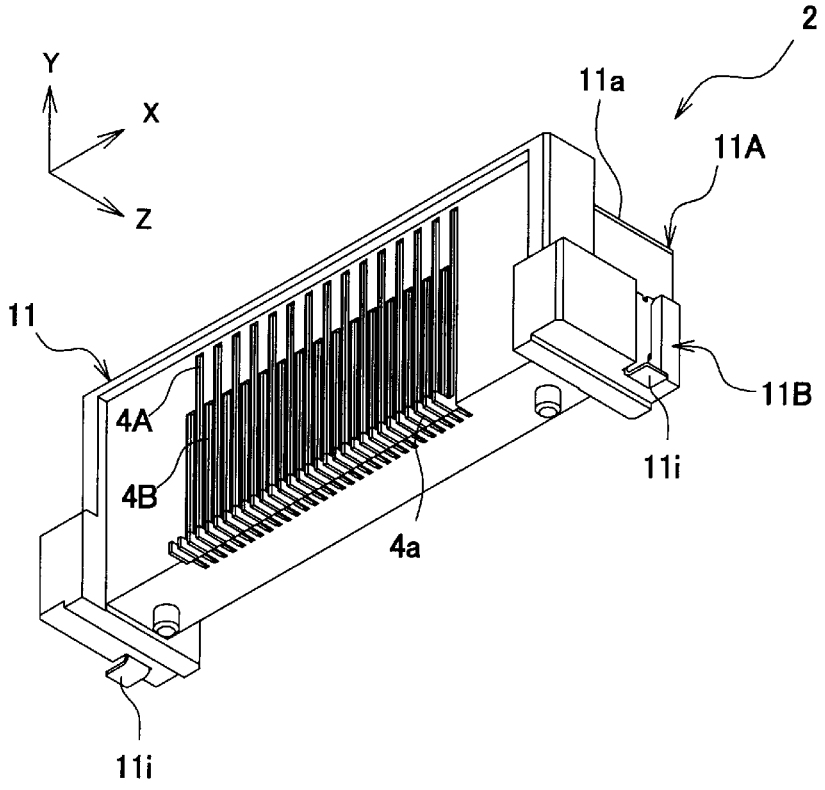
FIG. 15 is a rear-side perspective view which shows the socket connector of FIG. 14.
Figure 16:
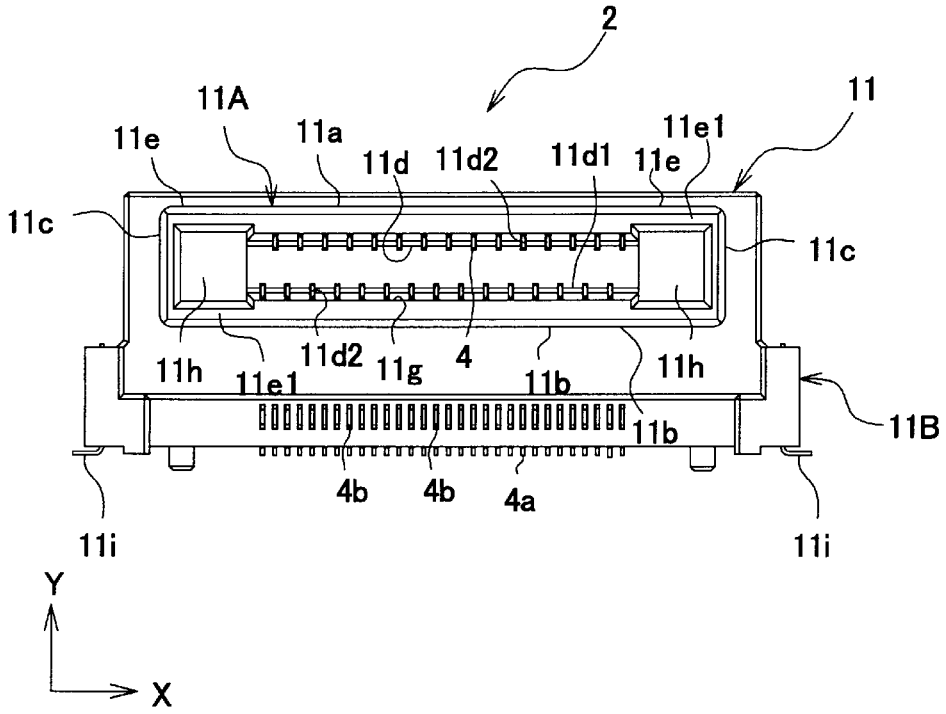
FIG. 16 is a front view which shows the socket connector of FIG. 14.
Figure 17:
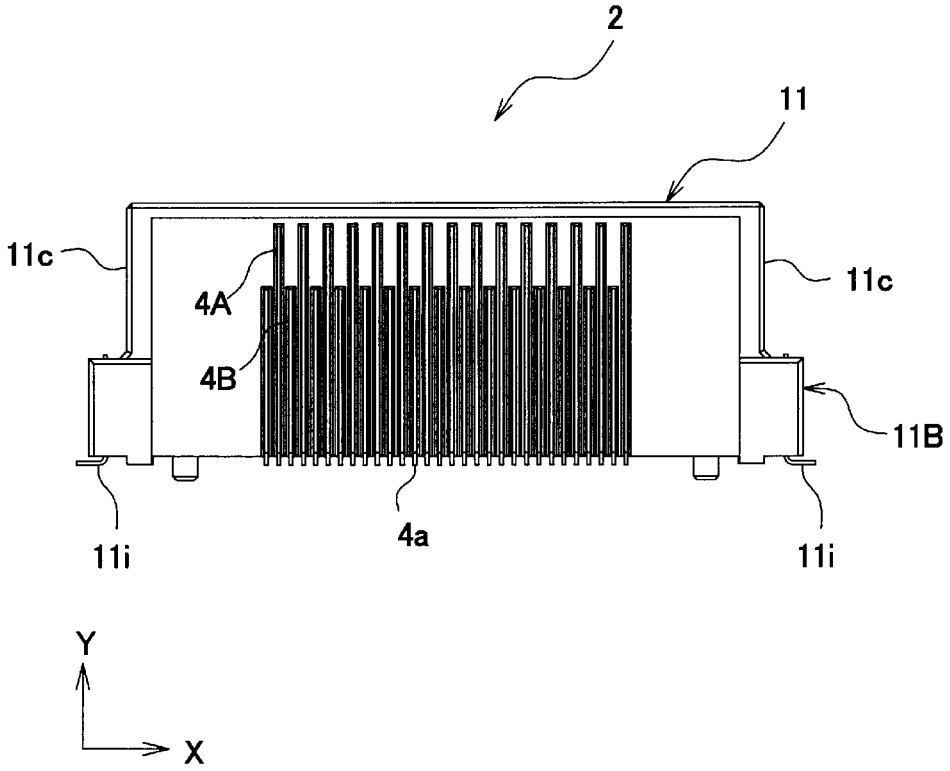
FIG. 17 is a rear view which shows the socket connector of FIG. 14.
Figure 18:
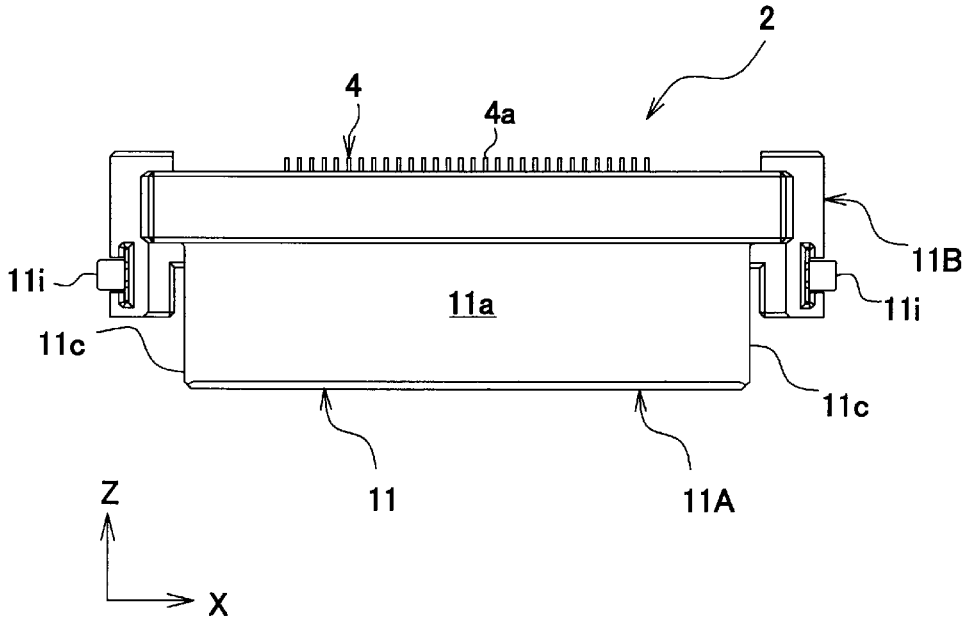
FIG. 18 is a plan view which shows the socket connector of FIG. 14.
Figure 19:
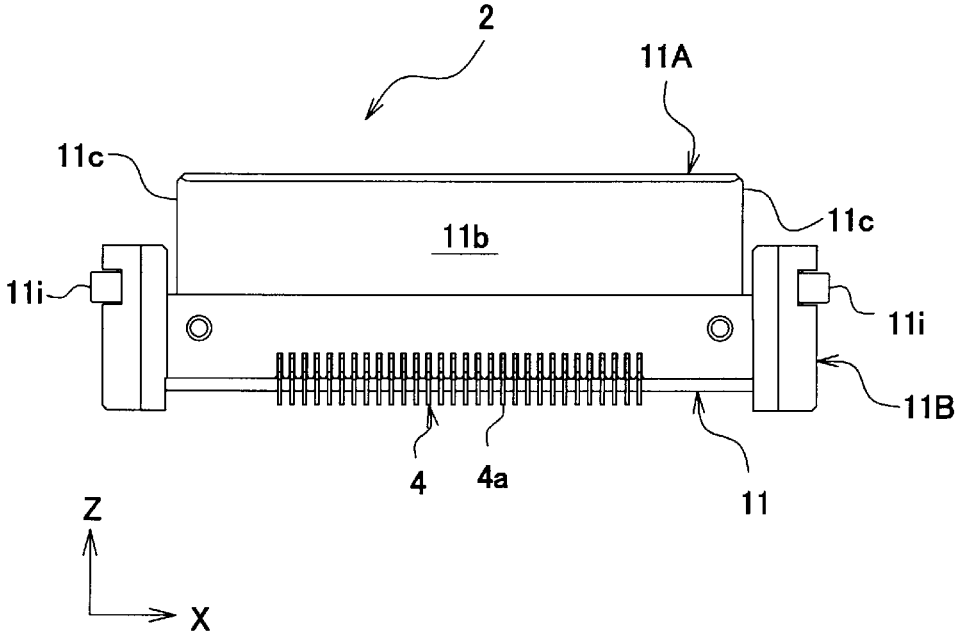
FIG. 19 is a bottom view which shows the socket connector of FIG. 14.
Figure 20:
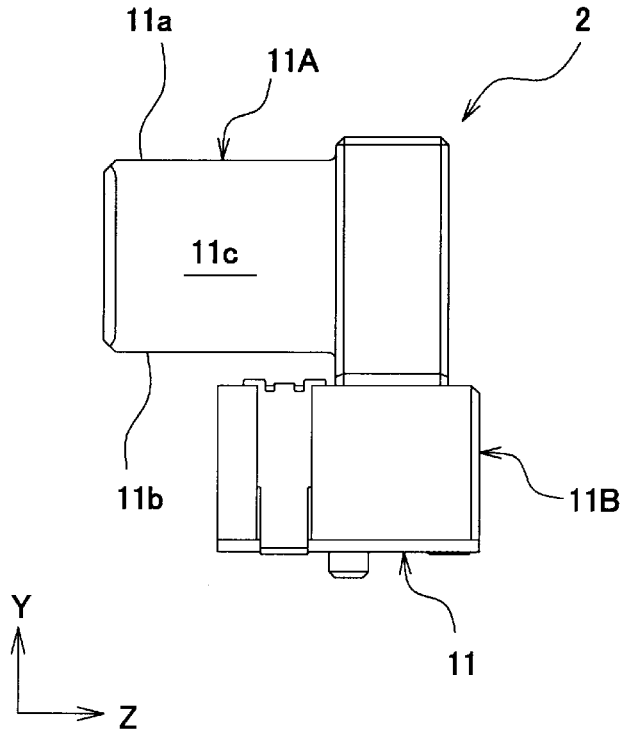
FIG. 20 is a right side view which shows the socket connector of FIG. 14.

Further, the first connection terminal 7A are also different from the second connection terminal 7B in the length of the switch sections 7*a*1, 7*a*2. That is, the height position of the upper end of the switch section 7*a*1 is substantially the same as the height position of the upper end of the plug contact section 3*a* in the first connection terminal 7A, while the height position of the switch section 7*a*2 is substantially half of the height position of the upper end of the plug contact section 3*a* in the second connection terminal 7B. In addition to that the switch sections 7*a*1, 7*a*2 have different lengths, the positions that the switch sections 7*a*1, 7*a*2 extend from the base 3*e* are opposite in the width direction X. Specifically, when the first and second connection terminals 7A, 7B are seen with the movable section 3*d* being on the front side and the plug contact section 3*a* being on the back side, the switch section 7*a*1 extends from the left end of the base 3*e* (FIG. 11), while the switch section 7*a*2 extends from the right end of the base 3*e* (FIG. 13).

Figure 32A:
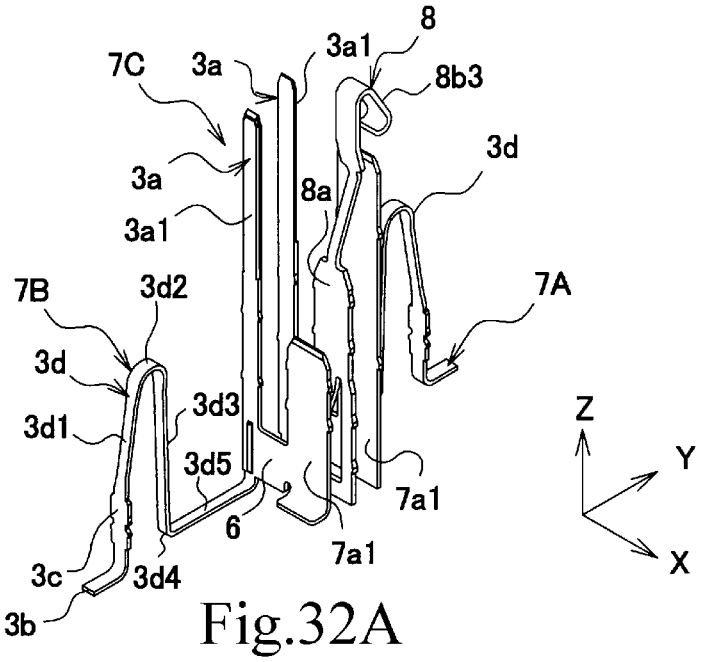
FIG. 32A is a perspective view which shows the terminals are in conductive contact with each other in an explanatory view which extracts the first connection terminal, the second connection terminal and the relay terminal from the plug connector of FIG. 1.

Since the switch sections 7*a*1, 7*a*2 extend from the opposite sides of the base 3*e* in the width direction X, the first and second connection terminals 7A, 7B form a pair of terminals 7C with the switch sections 7*a*1, 7*a*2 face each other in the front-back direction Y via the relay terminal 8 while the plug contact sections 3*a*, 3*a* are fixed in the terminal grooves 10*g*, 10*g* (FIG. 32A). Those terminal pairs 7C are provided on both ends in the width direction X of the fitting wall 10*a*, while the switch sections 7*a*1, 7*a*2 are housed in the guide poles 10*e*.

[Relay Terminal]

Figure 6:
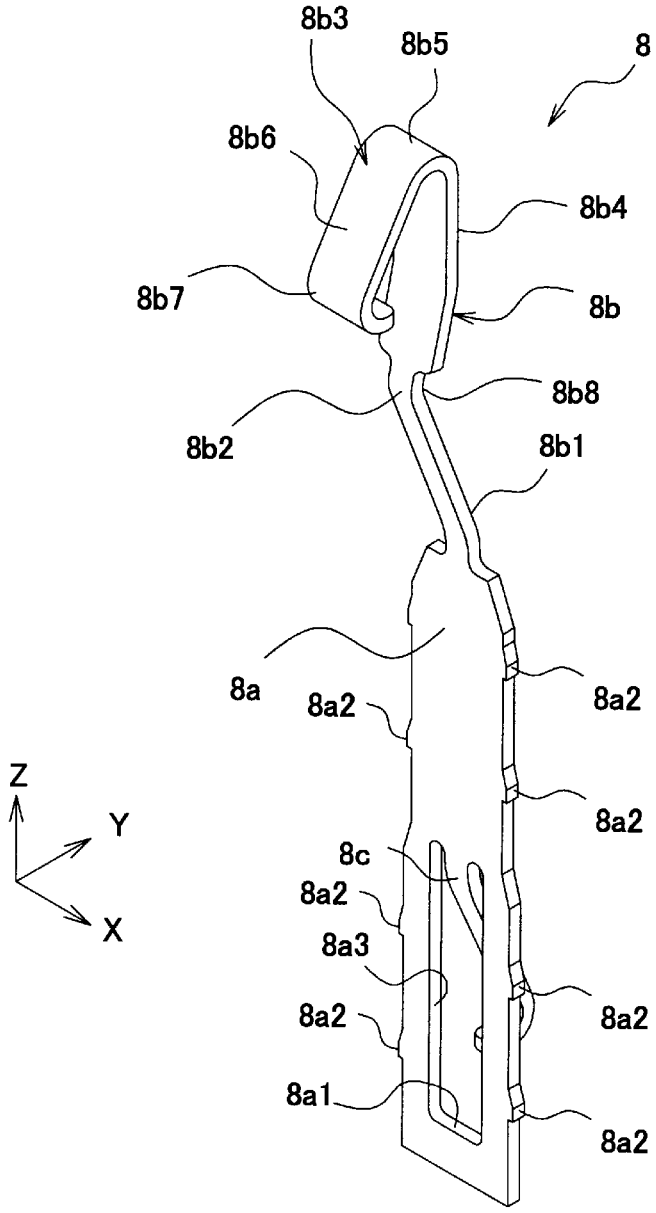
FIG. 6 is a front-side perspective view which shows a relay terminal according to an embodiment.
Figure 7:
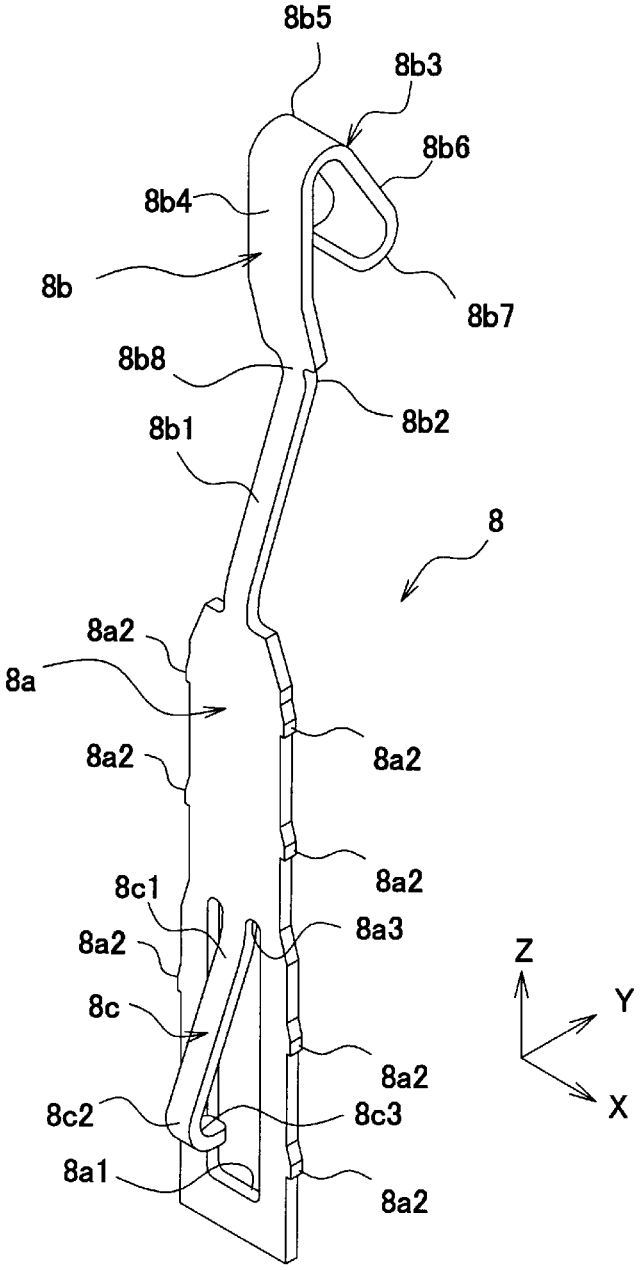
FIG. 7 is a rear-side perspective view which shows the relay terminal of FIG. 6.
Figure 8:
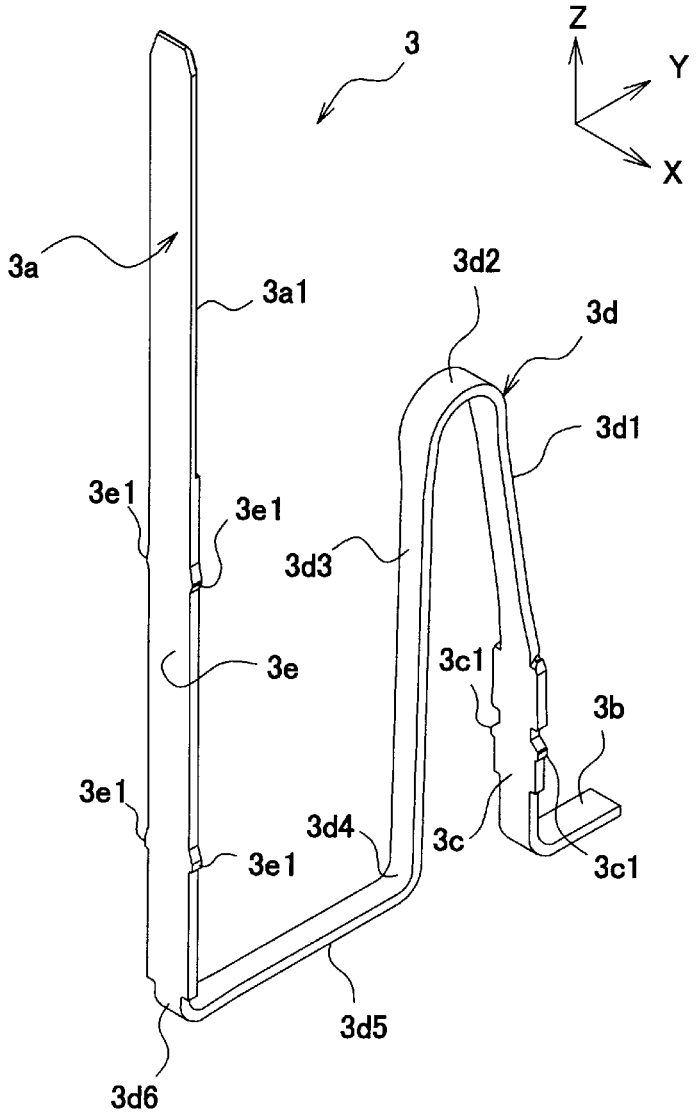
FIG. 8 is a front-side perspective view which shows the plug terminal of FIG. 1.
Figure 9:
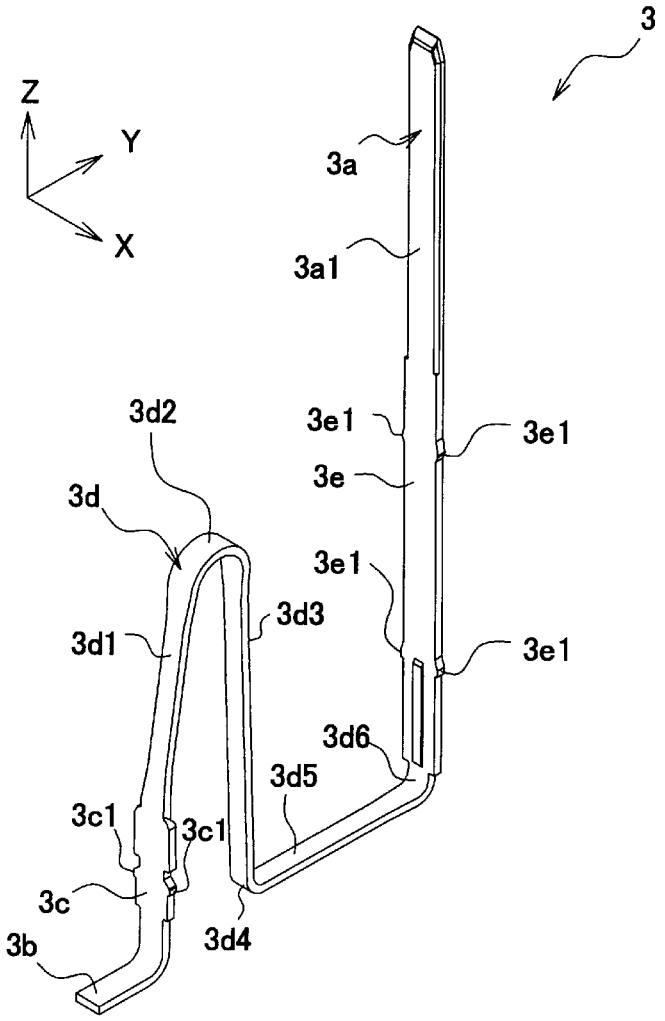
FIG. 9 is a rear-side perspective view which shows the plug terminal of FIG. 8.

As shown in FIGS. 6 and 7, the relay terminal 8 is formed by bending a metal piece formed by punching a metal plate. The relay terminal 8 includes a fixed base 8*a*, a switch contact piece 8*b* and a short circuit contact piece 8*c*.

The fixed base 8*a* is formed by a frame shaped metal plate having a substantially rectangular through hole 8*a*1. As shown in FIGS. 6 and 7, the short circuit contact piece 8*c* extends from the upper end of the hole edge 8*a*3 of the through hole 8*a*1 toward inside of the through hole 8*a*1. The short circuit contact piece 8*c* is formed by cutting out a metal piece of the fixed base 8*a*. Accordingly, the entire relay terminal 8 can be formed small in size compared with the case where the short circuit contact piece 8*c* is provided on the outer edge of the fixed base 8*a* so as to extend outward. Further, engagement projections 8*a*2 are provided on both ends of the housing fixation unit 3*c* in the width direction X. When the engagement projections 8*a*2 are fixed onto the inner wall (not shown in the figure) of the relay terminal housing groove 10*f* of the guide pole 10*e*, the relay terminal 8 is fixed to the movable housing 10.

The switch contact piece 8*b* includes a first elastic piece 8*b*1, a first short circuit contact 8*b*2 as a "short circuit contact", and an open contact 8*b*3. Further, the switch contact piece 8*b* includes a bending section 8*b*9 on the proximal end side which is connected to the fixed base 8*a* so as to serve as a displacement support for the switch contact piece 8*b*.

The first elastic piece 8*b*1 has a base end connected to the upper end of the fixed base 8*a* and extends upward while inclining toward the switch section 7*a*1 of the first connection terminal 7A. The upper end of the first elastic piece 8*b*1 has a bending section 8*b*8 that is bent in a direction away from the switch section 7*a*1.

The first short circuit contact 8*b*2 is provided on a plate surface of the bending section 8*b*8 of the first elastic piece 8*b*1 at a position most protruding in the contact direction with the switch section 7*a*1. Further, in the non-fitted state to the socket connector 2, the first short circuit contact 8*b*2 is in conductive contact with the switch section 7*a*1 of the first connection terminal 7A.

The open contact 8*b*3 includes an extending section 8*b*4 connected to the upper end of the first elastic piece 8*b*1 and extending upward, a turning section 8*b*5 turning back downward in a substantially U shape, and a pressed section 8*b*6 extending downward while inclining in a direction in which the first short circuit contact 8*b*2 comes into contact with the switch section 7*a*1 in the front-back direction Y. The lower end of the pressed section 8*b*6 is connected to a protruding section 8*b*7. The pressed section 8*b*6 and the protruding section 8*b*7 protrude from the relay terminal housing groove 10*f* toward inside of the plug-side fitting chamber 10*h* in a non-contact state to a pressing section 11*e*1 of the socket connector 2. As described above, the guide poles 10*e*, 10*e* of one plug connector 1 include the relay terminal housing grooves 10*f*, 10*f* that are open in different directions in the front-back direction Y. Accordingly, the pressed section 8*b*6 and the protruding section 8*b*7 of the open contact 8*b*3 protrude forward from the opening of one guide pole 10*e*, and the pressed section 8*b*6 and the protruding section 8*b*7 of the open contact 8*b*3 protrude backward from the opening of the other guide pole 10*e*.

When housed in the relay terminal housing groove 10*f* of the guide pole 10*e*, the open contact 8*b*3 is located at a position higher than the upper end of the switch section 7*a*1 of the first connection terminal 7A in the height direction Z. In particular, the pressed section 8*b*6 of the open contact 8*b*3 is positioned to extend just above the switch section 7*a*1 in the non-fitted state of the socket connector 2. Further, the pressed section 8*b*6 and the protruding section 8*b*7 are disposed on the opposite side to the first short circuit contact 8*b*2 with respect to the switch section 7*a*1 in the front-back direction Y. Accordingly, the open contact 8*b*3 is generally disposed to extend above the upper edge of the switch section 7*a*1. Further, the pressed section 8*b*6 and the protruding section 8*b*7 are disposed close to the pressing section 11*e*1 of the socket connector 2 in the fitting position than the first short circuit contact 8*b*2 in the front-back direction Y.

The first short circuit contact 8*b*2 and the open contact 8*b*3 are elastically supported by the first elastic piece 8*b*1. The open contact 8*b*3 is disposed on the distal end side with respect to the first short circuit contact 8*b*2. As the open contact 8*b*3 is elastically displaced, the first short circuit contact 8*b*2 is also elastically displaced in a coordinated manner.

The short circuit contact piece 8*c* includes a second elastic piece 8*c*1 and a second short circuit contact 8*c*2. The second elastic piece 8*c*1 extends from the hole edge 8*a*3 of the through hole 8*a*1 of the fixed base 8*a* as described above, and extends toward inside of the through hole 8*a*1 in the contact direction with the switch section 7*a*2 of the second connection terminal 7B. A bending section 8*c*3 is provided on the lower end of the second elastic piece 8*c*1, and a second short circuit contact 8*c*2 is provided at a position most protruding on a plate surface of the bending section 8*c*3. The second short circuit contact 8*c*2 is constantly in conductive contact with the switch section 7*a*2 of the second connection terminal 7B both in the non-fitted state and the fitted state with the socket connector 2. By providing the second short circuit contact 8*c*2 on the relay terminal 8 instead of on the second connection terminal 7B, a terminal configuration of the second connection terminal 7B can be simplified.

Accordingly, in the fitted state and the non-fitted state of the connectors 1, 2, the second short circuit contact 8*c*2 keeps in conductive contact with the plug contact section 3*a* of the plug terminal 12 and does not separate therefrom. If the relay terminal 8 is integrally formed with the first connection terminal 7A or the second connection terminal 7B having the first short circuit contact 8*b*2 or the open contact 8*b*3, the connection terminals 7A, 7B have a complicated configuration, which causes difficulty in manufacturing. In this embodiment, however, since the relay terminal 8 are separately provided from the first connection terminal 7A or the second connection terminal 7B, the connection terminals 7A, 7B have a simple configuration, thereby improving a manufacturing accuracy.

Figure 32B:
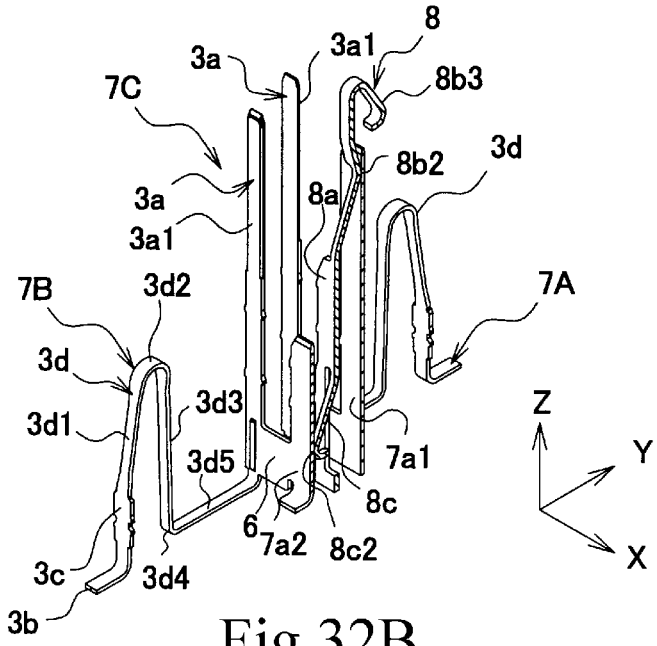
FIG. 32B is a cross sectional view of the terminals at their contact portion in an explanatory view which extracts the first connection terminal, the second connection terminal and the relay terminal from the plug connector of FIG. 1.

Further, the first short circuit contact 8*b*2 and the open contact 8*b*3 are disposed at the same position in the width direction X of the switch contact piece 8*b* (FIG. 32B). This prevents the switch contact piece 8*b* from increasing in size in the width direction X.

[Socket Connector]

As shown in FIGS. 14 to 20, the socket connector 2 includes a socket housing 11, and a plurality of socket terminals 4A, 4B. The socket terminals 4A, 4B have different shapes.

[Socket Housing]

The socket housing 11 is made of an insulative resin, and includes a leg 11B and a fitting section 11A.

The leg 11B has a substantially cuboid shape, and is disposed on the rear side of the socket housing 11 in the front-back direction Y (up-down direction in FIGS. 14 to 20). Metal fittings 11*i* are each disposed on both ends of the leg 11B in the width direction X so that the socket housing 11 is soldered to the substrate P1 by the metal fittings 11*i*.

The fitting section 11A has a substantially cuboid shape, and is disposed on the front side of the socket housing 11 in the front-back direction Y. Further, the fitting section 11A includes a front wall 11*a* and a rear wall 11*b* which extend in the width direction X, and side walls 11*c*, 11*c* which extend in the front-back direction Y so as to connect the front wall 11*a* and the rear wall 11*b*. Further, the fitting section 11A includes a socket-side fitting chamber 11*d*, a guide pole inserting section 11*h* and a terminal housing 11*f*. An insertion port 11*g* is provided on the lower end of the fitting section 11A so that the fitting wall 10*a* and the plug contact section 3*a* of the plug connector 1 are inserted therein.

The socket-side fitting chamber 11*d* and the guide pole inserting section 11*h* are formed to communicate each other as a space surrounded by the front wall 11*a*, the rear wall 11*b* and the side walls 11*c*, 11*c*. The socket-side fitting chamber 11*d* is disposed in the fitting section 11A at the center in the width direction X, and each of the guide pole inserting sections 11*h*, 11*h* are disposed on each end of the socket-side fitting chamber 11*d* close to each of the side walls 11*c*, 11*c*. An opening 11*d*2 is disposed on the inner wall 11*d*1 on the front wall 11*a* and the rear wall 11*b* at a position close to the socket-side fitting chamber 11*d* so as to communicate the socket-side fitting chamber 11*d* and the terminal housing 11*f*. A front contact 12*b*1 and a rear contact 13*b*1 of the socket terminals 4A, 4B, which will be described below, protrude from the opening 11*d*2 so as to be in conductive contact with the plug contact section 3*a* in the socket-side fitting chamber 11*d*.

Thin wall sections 11*e* having a thickness smaller than that of the center part are disposed on both ends of the front wall 11*a* and the rear wall 11*b* in the width direction X. Accordingly, the guide pole inserting sections 11*h* is formed longer in the front-back direction Y than the socket-side fitting chamber 11*d*. The inner shape of the guide pole inserting section 11*h* is formed depending on the outer shape of the guide pole 10*e*. Further, the pressing section 11*e*1 is disposed on the thin wall section 11*e* of the front wall 11*a* so as to press and elastically deform the open contact 8*b*3 of the relay terminal 8 of the plug connector 1 when the socket connector 2 and the plug connector 1 are fitted.

A plurality of terminal housings 11*f* are arranged side by side in the width direction X on the front wall 11*a* and the rear wall 11*b* of the socket housing 11. Each of the socket terminal 4A or the socket terminal 4B are housed in a corresponding one of the terminal housings 11*f*. The terminal housings 11*f* on the front wall 11*a* and the terminal housings 11*f* on the rear wall 11*b* are offset in the width direction X and are arranged in a zigzag pattern in plan view.

[Socket Terminal]

Figure 21:
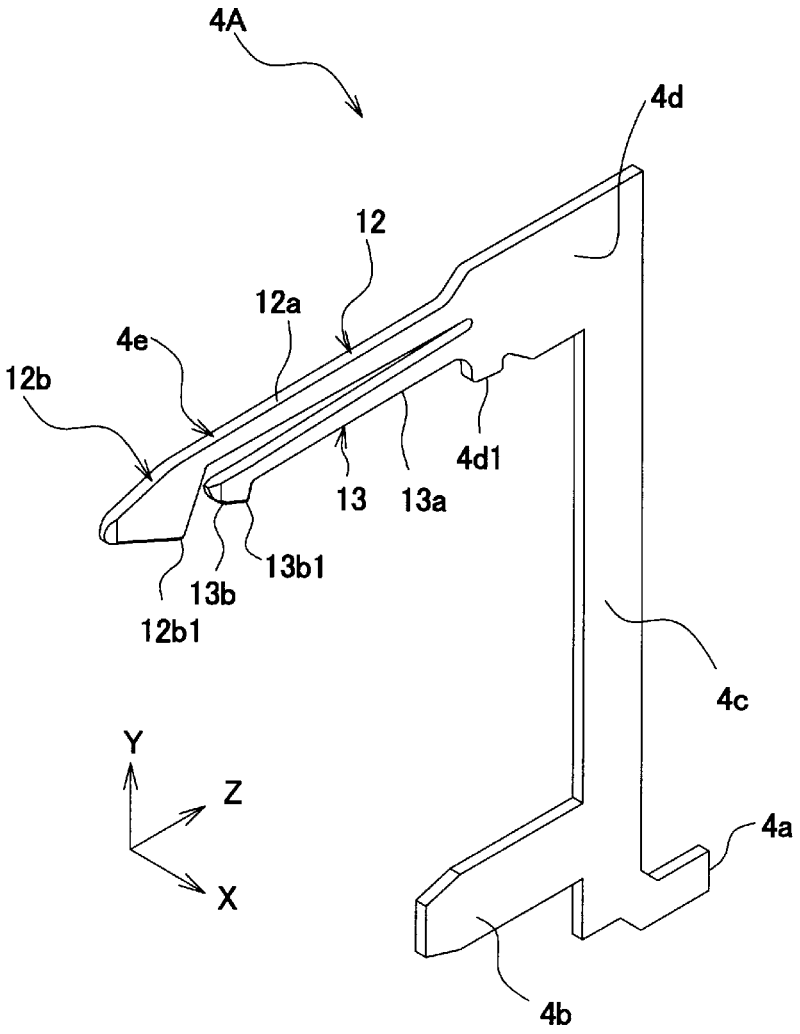
FIG. 21 is a perspective view which shows the socket terminal of FIG. 14.
Figure 22:
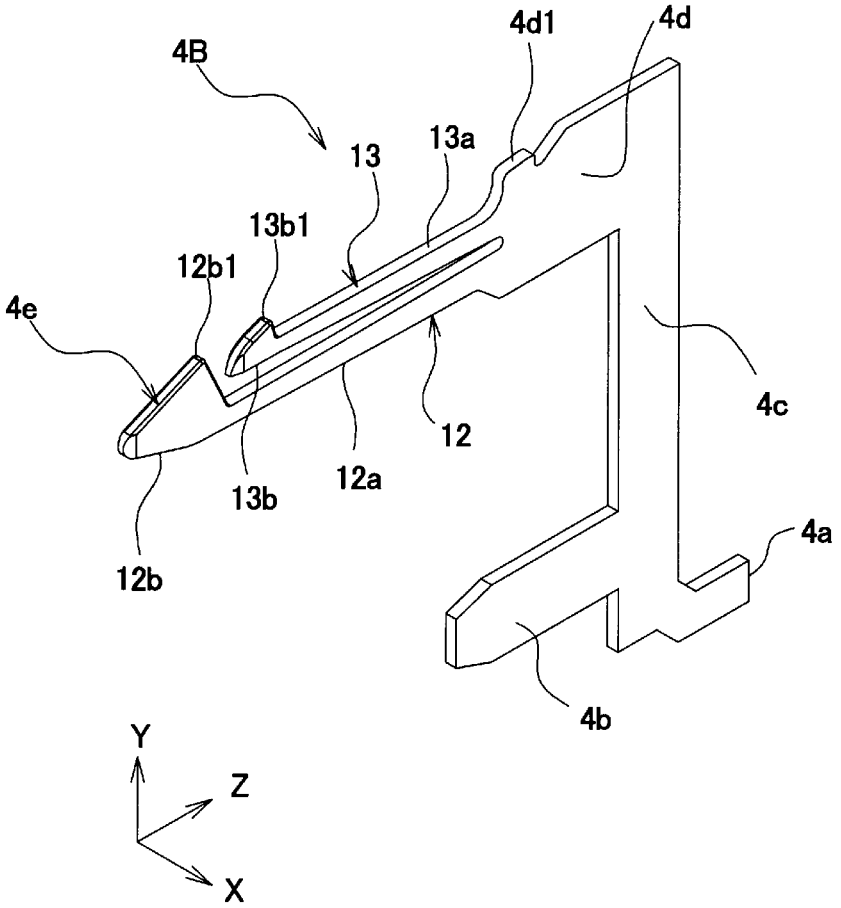
FIG. 22 is a perspective view which shows a different socket terminal from the socket terminal of FIG. 14.
Figure 23:
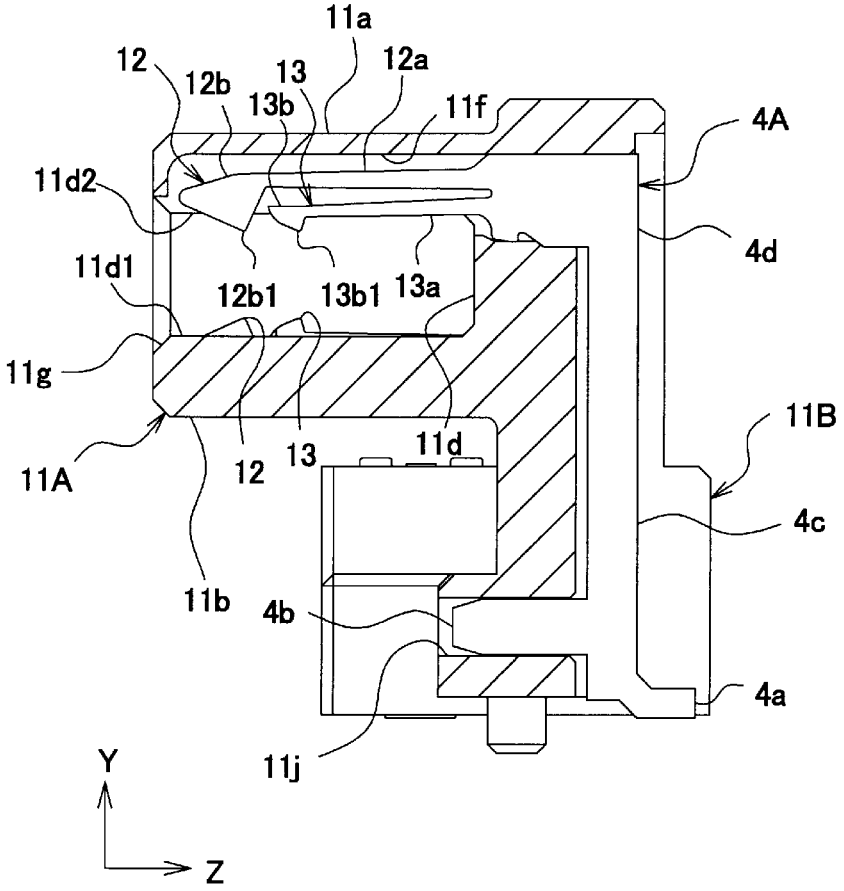
FIG. 23 is a cross sectional view of the socket connector which shows a mounting state of the socket terminal of FIG. 21.
Figure 24:
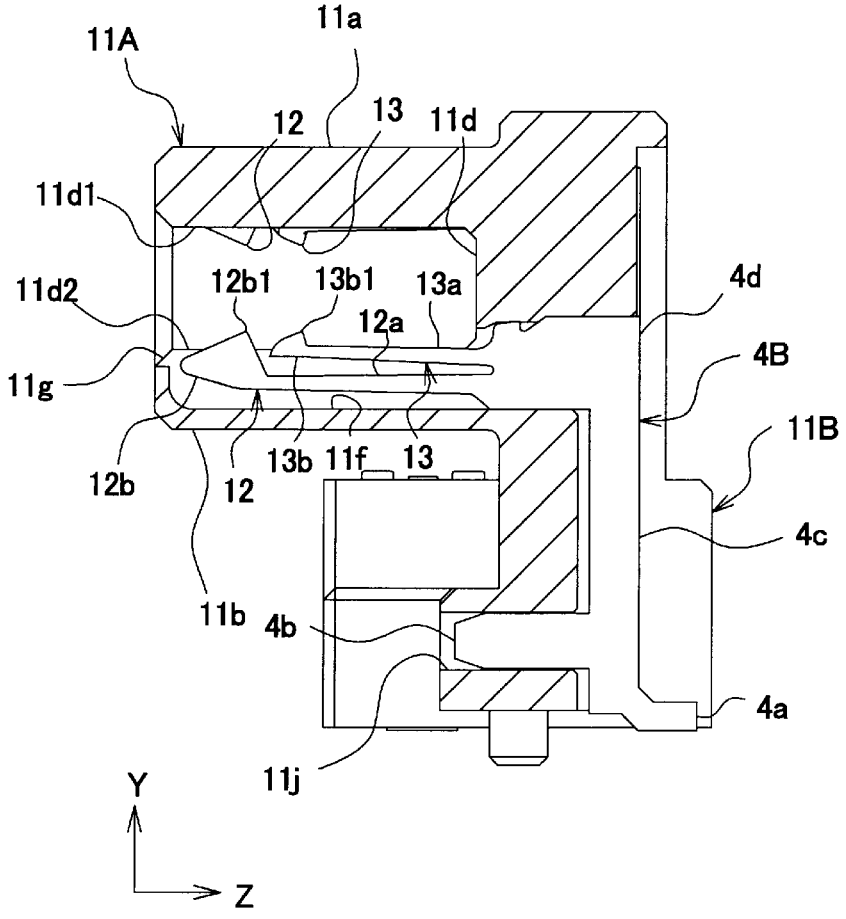
FIG. 24 is a cross sectional view of the socket connector which shows a mounting state of the socket terminal of FIG. 22.
Figure 25:
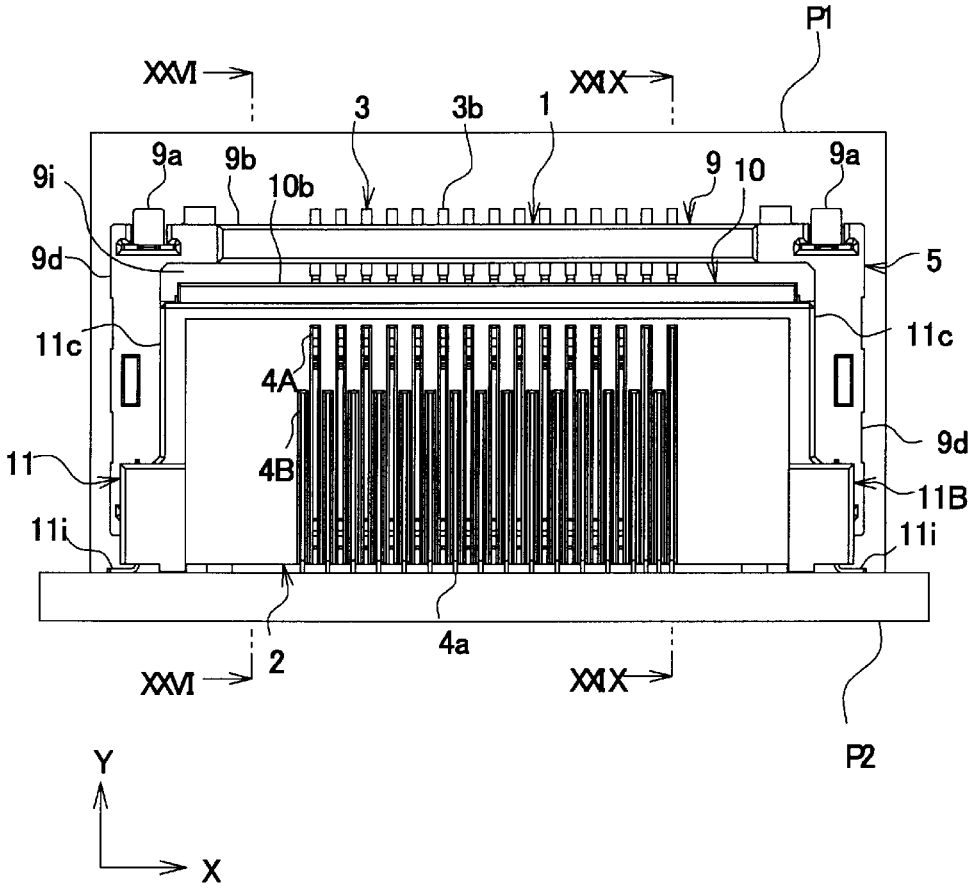
FIG. 25 is an explanatory view which shows a fitted state of the plug connector of FIG. 1 and the socket connector of FIG. 14.

As shown in FIGS. 21 to 22, the socket terminals 4A, 4B are provided as punched terminals formed by punching a metal plate. Each of the socket terminals 4A, 4B are housed in a corresponding one of the terminal housings 11*f* of the socket housing 11 with the plate surface of the metal piece extending in the front-back direction Y and the height direction Z. Further, the socket terminals 4A and the socket terminals 4B are offset in the width direction X and are arranged in a zigzag pattern in plan view.

The socket terminals 4A, 4B include a substrate connecting section 4*a*, a housing fixation unit 4*b*, a connection section 4*c*, a proximal end 4*d* and a terminal section 4*e*.

The substrate connecting section 4*a* extends in the height direction Y and is soldered to the substrate P2.

The housing fixation unit 4*b* is formed of a plate having a substantially rectangular plate surface. When press fitted in a fixation hole 11*j* of the socket housing 11, the socket terminals 4A, 4B are fitted in the socket housing 11.

The connection section 4*c* is connected to the front end of the housing fixation unit 4*b*, and extends forward (up direction in FIGS. 21 and 22) in the front-back direction Y. The socket terminal 4A is different from the socket terminal 4B in the length of the connection section 4*c* in the front-back direction Y, and the connection section 4*c* of the socket terminal 4A has a length larger than that of the connection section 4*c* of the socket terminal 4B.

The proximal end 4*d* is formed in a substantially rectangular shape connected to the front end of the connection section 4*c* and extending downward (left direction in FIGS. 21 and 22) in the height direction Z. Engagement sections 4*d*1 that are fixed in the socket housing 11 are provided on both ends of the proximal end 4*d* in the front-back direction Y. When the engagement sections 4*d*1 are fitted onto the inner wall (not shown in the figure) of the terminal housing 11*f* of the socket housing 11, the socket terminals 4A, 4B are fixed to the socket housing 11.

The terminal section 4*e* is connected to the lower end of the proximal end 4*d*, and includes a front terminal 12 which is in conductive contact with the plug contact section 3*a* and a rear terminal 13.

The front terminal 12 includes a front elastic piece 12*a* and a front contact 12*b*.

The front elastic piece 12*a* is formed by an elastic piece of a narrow shaft which downwardly extends from the lower end of the proximal end 4*d*.

The front contact 12*b* is connected to the lower end of the front elastic piece 12*a*. The front contact 12*b* protrudes in a chevron shape in a contact direction to the plug contact section 3*a* of the plug connector 1 in the fitted state. A front contact 12*b*1 is provided on the protruding portion so as to be in conductive contact with the terminal surface 3*a*1 of the plug contact section 3*a*. The front contact 12*b*1 is in sliding contact with the terminal surface 3*a*1 when the connectors 1, 2 are fitted.

The rear terminal 13 includes a rear elastic piece 13*a* and a rear contact 13*b*.

The rear elastic piece 13*a* is formed by an elastic piece of a narrow shaft which downwardly extends from the lower end of the proximal end 4*d*. The rear elastic piece 13*a* is disposed adjacent to the front elastic piece 12*a* so that the rear elastic piece 13*a* is disposed close to the plug terminal 3 of the plug connector 1 in the fitting state than the front elastic piece 12*a*.

The rear contact 13*b* is connected to the lower end of the rear elastic piece 13*a*. The rear contact 13*b* protrudes in a chevron shape toward the plug contact section 3*a* of the plug connector 1 in the fitted state. A rear contact 13*b*1 is provided on the protruding portion so as to be in conductive contact with the terminal surface 3*a*1 of the plug contact section 3*a*. Since the rear contact 13*b*1 is disposed on the back side with respect to the front contact 12*b*1 in the fitting direction of the plug connector 1, the plug terminal 3 is first in sliding contact with the front contact 12*b*1 and then with the rear contact 13*b*1 in the fitting state. The rear contact 13*b*1 and the plug contact section 3*a* are positioned in the fitting direction of the plug connector 1 at the same position in the width direction X and the front-back direction Y. Accordingly, in the fitting state of the plug connector 1, the rear contact 13*b*1 follows the front contact 12*b*1 and is brought into sliding contact with the sliding locus of the front contact 12*b*1.

The proximal ends 4*d*, the front terminals 12 and the rear terminals 13 of the socket terminals 4A, 4B are positioned symmetrically to the front-back direction Y. That is, in the socket terminal 4A having a long connection section 4*c*, the front contact 12*b*1 and the rear contact 13*b*1 are disposed to face the housing fixation unit 4*b* in the front-back direction Y. On the other hand, in the socket terminal 4B having a short connection section 4*c*, the front contact 12*b*1 and the rear contact 13*b*1 are disposed to face the opposite side of the housing fixation unit 4*b* in the front-back direction Y. The substrate connecting sections 4*a* of the socket terminals 4A, 4B are soldered to the same substrate P2. Accordingly, depending on the difference in length of the connection section 4*c*, the distance from the terminal sections 4*e* of the socket terminals 4A, 4B from the substrate P2 are different. Accordingly, the terminal sections 4*e*, 4*e* of the socket terminals 4A, 4B are positioned at the same distance from the substrate P2. The terminal grooves 10*g* are formed on both the front side and the rear side of the fitting wall 10*a* of the plug connector 1, and the plug contact sections 3*a* disposed on the front side of the terminal grooves 10*g* are positioned away from the substrate P2. The plug contact sections 3*a* disposed on the rear side of the terminal grooves 10*g* are positioned close to the substrate P2. Accordingly, the terminal sections 4*e*, 4*e* of the socket terminal 4A, 4B and the plug contact sections 3*a* are positioned at the same positions in the front-back direction Y so that the socket terminals 4A, 4B are in conductive contact with the plug terminals 3 in the fitted state of the socket connector 2 and the plug connector 1.

[Description of Usage]

Figure 29:
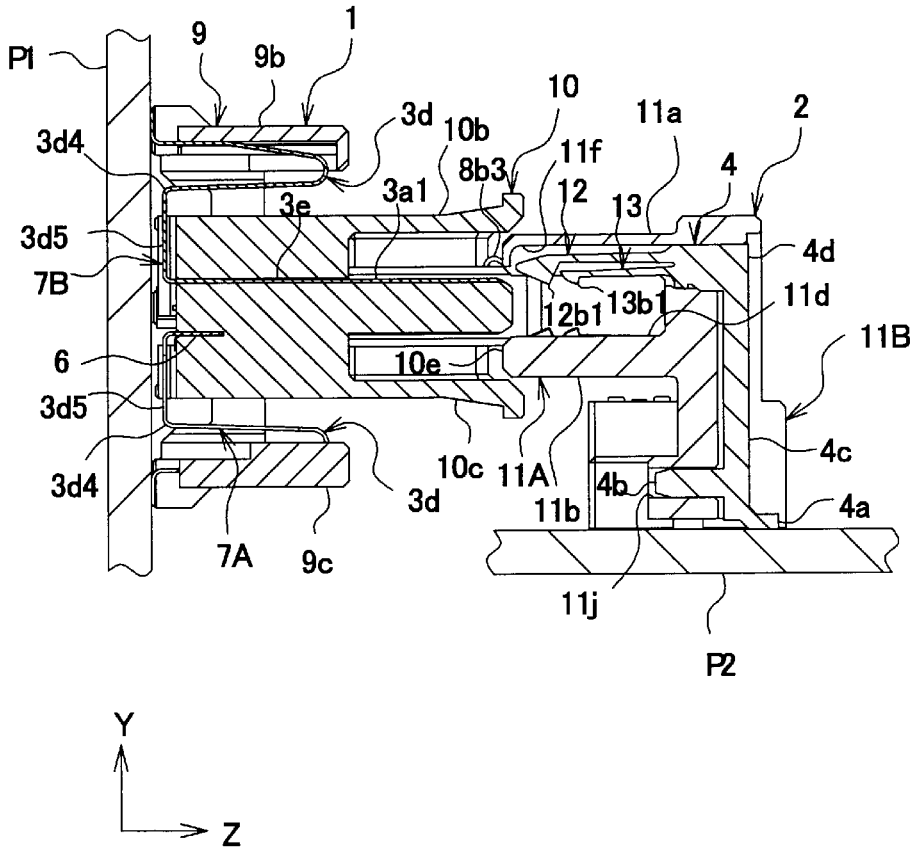
FIG. 29 is a cross sectional view which shows the plug connector and the socket connector in a non-fitted state taken along the line XXIX-XXIX of FIG. 25.
Figure 30:
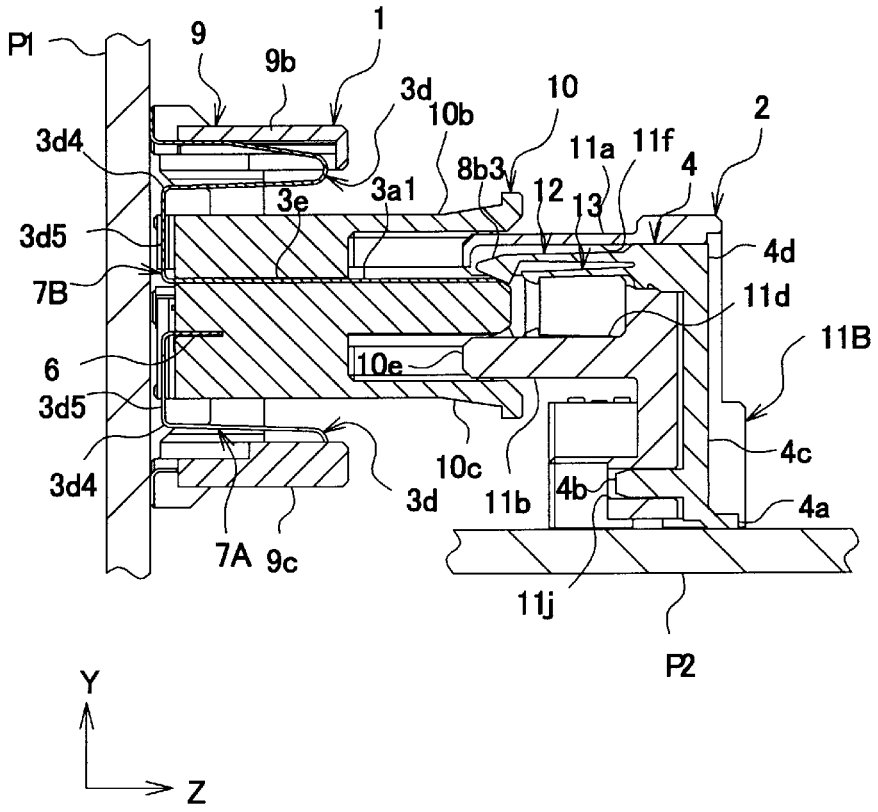
FIG. 30 is a cross sectional view corresponding to FIG. 29 which shows the plug connector and the socket connector in a half-fitted state.
Figure 31:
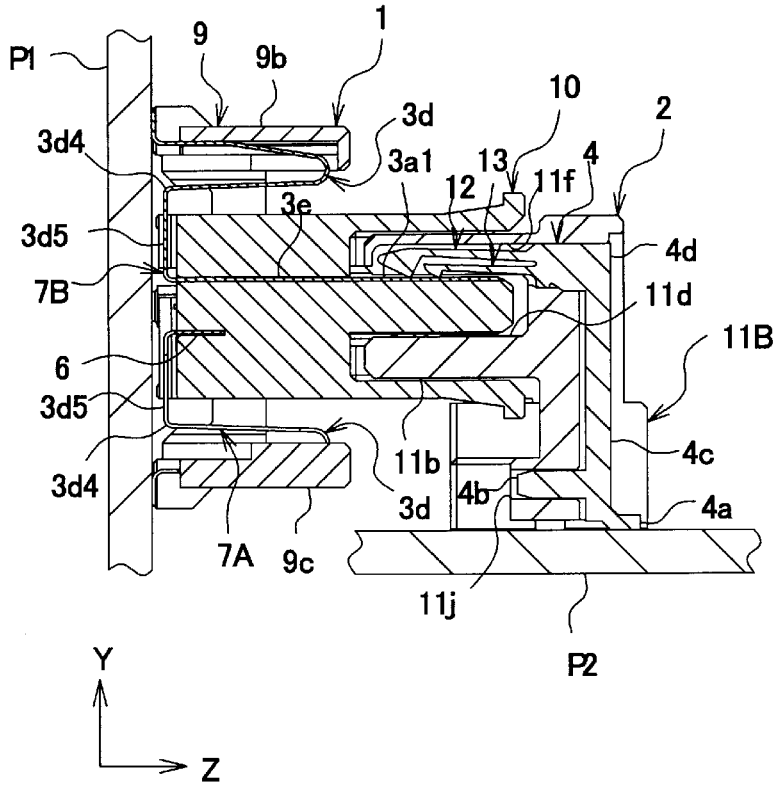
FIG. 31 is a cross sectional view corresponding to FIG. 29 which shows the plug connector and the socket connector in a fitted state.

The usage of the plug connector 1 according to the present embodiment will be described particularly referring to FIGS. 26 to 32. FIGS. 26 and 29, FIGS. 27 and 30, and FIGS. 28 and 31 are sectional views which show the same phase in the fitting process of the plug connector 1 and the socket connector 2. That is, FIGS. 26 and 29 show a non-fitted state, FIGS. 27 and 30 show a half-fitted state, and FIGS. 28 and 31 show a fitted state.

The plug connector 1 is fixed to the substrate P1 and the socket connector 2 is fixed to the substrate P2. As shown in FIG. 26, in the non-fitted state with the socket connector 2, the plug connector 1 has the first short circuit contact 8*b*2 of the relay terminal 8 in conductive contact with the first connection terminal 7A, and the second short circuit contact 8*c*2 in conductive contact with the second connection terminal 7B. Accordingly, in this state, a closed circuit is formed in which the substrate P1, the first connection terminal 7A, the relay terminal 8 and the second connection terminal 7B are shorted.

Then, the fitting section 11A of the socket connector 2 is inserted in the plug-side fitting chamber 10*h* from the insertion port 9*e* of the plug connector 1. As described above, the distal end of the guide pole 10*e* of the plug connector 1 protrudes upward with respect to the front wall 10*b*, the rear wall 10*c* and the side walls 10*c*, 10*c* of the movable housing 10. Accordingly, the guide poles 10*e* can be inserted in the guide pole inserting sections 11*h* while the distal ends of the two guide poles 10*e*, 10*e* of the plug connector 1 are aligned to the openings of the guide pole inserting sections 11*h*, 11*h* of the socket connector 2. Thus, the fitting wall 10*a* of the plug connector 1 and the plug contact section 3*a* of the plug terminal 12 are inserted in the socket-side fitting chamber 11*d* of the socket connector 2. In so doing, the guide pole 10*e* can be used as a guide for fitting of the plug connector 1 and the socket connector 2. The guide pole 10*e* houses the relay terminal 8 as described above, and the outer shape of the guide pole 10*e* serves as a guide for fitting of the connectors 1, 2. Since the guide pole 10*e* has two functions as described above, the entire plug housing 5 can be reduced in size compared with the case in which two functions are provided in separate members.

As shown in FIG. 26, the pressed section 8*b*6 and the protruding section 8*b*7 of the open contact 8*b*3 of the relay terminal 8 are disposed on the opposite side to the first short circuit contact 8*b*2 with respect to the switch section 7*a*1 in the front-back direction Y. In fitting the socket connector 2, the distal end of the pressing section 11*e*1 of the socket housing 11 first presses the pressed section 8*b*6 in the plug-side fitting chamber 10*h*. Then, when the socket connector 2 is further fitted, the pressing section 11*e*1 of the socket housing 11 pushes open a gap between the inner wall 10*h*1 of the plug-side fitting chamber 10*h* and the protruding section 8*b*7 so as to be inserted therein. During the fitting operation, the pressing section 11*e*1 of the socket housing 11 is in sliding contact with the pressed section 8*b*6 and the protruding section 8*b*7 of the open contact 8*b*3, but is not in contact with the first short circuit contact 8*b*2. The open contact 8*b*3 pressed by the pressing section 11*e*1 is generally elastically displaced in the direction in which the first short circuit contact 8*b*2 moves away from the switch section 7*a*1 in the front-back direction Y, and the pressed section 8*b*6 and the protruding section 8*b*7 are further inserted into the relay terminal housing groove 10*f*.

In so doing, the switch contact piece 8*b* is displaced by using the bending section 8*b*9 disposed on the proximal end side which is connected to the fixed base 8*a* as a displacement support. The switch contact piece 8*b* includes a first short circuit contact 8*b*2 on the proximal end side, and an open contact 8*b*3 on the distal end side to the first short circuit contact 8*b*2. Accordingly, by utilizing the principle of lever, the entire switch contact piece 8*b* can be elastically displaced by pressing the open contact 8*b*3 on the distal end side with a small amount of force. Further, the first short circuit contact 8*b*2 on the proximal end side can be in conductive contact with the switch section 7*a*1 of the first connection terminal 7A with a higher contact pressure. Since the first short circuit contact 8*b*2 is provided on the plate surface of the bending section 8*b*8 that is bent in the contact direction with the first connection terminal 7A, a contact pressure can be increased by decreasing the contact area with the switch section 7*a*1 of the first connection terminal 7A.

Since the first short circuit contact 8*b*2 is elastically supported by the first elastic piece 8*b*1 similarly to the open contact 8*b*3, the first short circuit contact 8*b*2 coordinates with the displacement of the open contact 8*b*3. Accordingly, when the open contact 8*b*3 is elastic displaced in a direction away from the switch section 7*a*1 of the first connection terminal 7A in the front-back direction Y, the first short circuit contact 8*b*2 is also displaced in a coordinated manner in a direction away from the switch section 7*a*1 (FIG. 27). Accordingly, a closed circuit between the plug connector 1 and the substrate P1 can be opened. After that, when the fitting section 11A of the socket connector 2 is deeply inserted into the plug-side fitting chamber 10*h*, the fitting operation of the connector 1, 2 is completed (FIG. 28). As described above, the first short circuit contact 8*b*2 of the relay terminal 8 is elastically displaced in a direction away from the switch section 7*a*1 of the first connection terminal 7A in the non-contact state with the pressing section 11*e*1 of the socket connector 2. Accordingly, since the first short circuit contact 8*b*2 does not have damage due to sliding contact of the socket connector 2, the first short circuit contact 8*b*2 can be in conductive contact with the switch section 7*a*1 in a stable manner even if the socket connector 2 is repeatedly inserted and removed.

In this state, the first elastic piece 8*b*1 of the relay terminal 8 is elastically deformed when pressed by the front wall 11*a* and the rear wall 11*b* of the socket connector 2. Accordingly, the pressing section 11*e*1 is pressed by a restoring force of the first elastic piece 8*b*1 attempting to return into an original shape. When the fitting section 11A of the socket connector 2 is removed from the plug-side fitting chamber 10*h* of the plug connector 1, the socket terminals 4A, 4B are first separated from the plug terminal 3, and then the pressing section 11*e*1 is separated from the open contact 8*b*3. Accordingly, the open contact 8*b*3 is displaced toward the switch section 7*a*1 of the first connection terminal 7A due to the restoring force so that the protruding section 8*b*7 and the pressed section 8*b*6 are inserted in the plug-side fitting chamber 10*h* (FIG. 26). Further, the first short circuit contact 8*b*2 is displaced similarly to the first open contact 8*b*3 and comes into conductive contact with the first connection terminal 7A. Accordingly, a closed circuit is again formed by the substrate P1, the first connection terminal 7A, the relay terminal 8 and the second connection terminal 7B.

The first connection terminal 7A and the second connection terminal 7B serve as a signal connection terminal, and the relay terminal 8 serves as a short circuit/open terminal separately from those members. Since the relay terminal allows for a short circuit connection between the first connection terminal 7A and the second connection terminal 7B without interposing the socket connector 2, a closed circuit can be formed in the non-fitted state of the socket connector 2 without elastically deforming the first connection terminal 7A and the second connection terminal 7B, which are signal connection terminals, for a short circuit connection. Accordingly, by inserting and removing the socket connector 2 into and from the plug connector 1, the short circuit contact 8*b*2 of the relay terminal 8 is displaced so as to be or not to be in contact with the first connection terminal 7A, thereby forming the above closed circuit or opening the closed circuit to establish a circuit between the substrates P1, P2. Thus, it is possible to normally use the closed circuit only and to fit the socket connector 2 fixed to the substrate P2 with the plug connector 1 only when the product function is desired to be extended. In addition, when the function becomes unnecessary, the socket connector 2 can be removed from the plug connector 1 to establish the original closed circuit.

[Description of Switching Method of Connection Circuit]

Assuming that the open contact 8*b*3 is located at a position on the lower side to the distal ends of the first short circuit contact 8*b*2 and the plug contact section 3*a* and away from the insertion port 9*e*. In this case, before the pressing section 11*e*1 of the socket connector 2 comes into press contact with the pressed section 8*b*6 of the open contact 8*b*3, the plug contact section 3*a* of the plug terminal 12 comes into contact with the terminal section 4*e* of the socket terminal 4A, 4B. Accordingly, the first short circuit contact 8*b*2 comes into conductive contact with the first connection terminal 7A in a half-fitted state in which the plug connector 1 and the socket connector 2 are not fitted to a full extent. As a result, the plug contact section 3*a* comes into conductive contact with the terminal section 4*e* of the socket terminals 4A, 4B while the closed circuit is formed. This may cause a problem that an intended proper circuit cannot be formed when an operator unintentionally stops the fitting operation in the half-fitted state, leading to a malfunction of the electric device to which the plug connector 1 is mounted.

In this embodiment, however, the pressed section 8*b*6 of the open contact 8*b*3 is disposed on the upper side to the distal end of the plug contact section 3*a* in the height direction Z. Further, since the pressing section 11*e*1 protrudes downward from the distal end of the terminal section 4*e* of the socket terminals 4A, 4B, the pressing section 11*e*1 is inserted in the plug-side fitting chamber 10*h* before the distal end of the terminal section 4*e* of the socket terminals 4A, 4B in the fitting operation. Accordingly, the pressing section 11*e*1 of the socket housing 11 comes into contact with the open contact 8*b*3 before the socket terminals 4A, 4B comes into conductive contact with plug contact section 3*a* during fitting with the socket connector 2 (FIGS. 26 and 29). That is, in the fitting operation, the first short circuit contact 8*b*2 is first separated from the first connection terminal 7A so that conductive contact between the relay terminal 8 and the first connection terminal 7A is released and the closed circuit between the plug connector 1 and the substrate P1 are opened. Then, the first and second connection terminals 7A, 7B and the plug terminal 3 come into conductive contact with the terminal section 4*e* of the socket terminals 4A, 4B so that a circuit is formed by the substrate P1, the plug terminal 3, the socket terminals 4A, 4B and the substrate P2 (FIGS. 27, 28, 30 and 31). Thus, since the pressed section 8*b*6 of the open contact 8*b*3 is disposed on the upper side to the distal end of the plug contact section 3*a* in the height direction Z, the closed circuit is reliably disconnected, and then, conductive connection between the substrate P1 and the substrate P2 can be established.

[Description of Function of Removing Foreign Substance]

The front contact 12*b*1 and the rear contact 13*b*1 of the socket terminals 4A, 4B are disposed in the insertion direction of the socket connector 2 into the plug connector 1. During fitting of the plug connector 1 and the socket connector 2, the front contact 12*b*1 comes into sliding contact with the terminal surface 3*a*1 of the plug contact section 3*a*. Subsequently, the rear contact 13*b*1 comes into conductive contact with the sliding locus. Accordingly, the front contact 12*b*1 wipes over the terminal surface 3*a*1 of the plug contact section 3*a* so as to remove a foreign substance, and then the rear contact 13*b*1 can be in conductive contact with that area. This can prevent a contact failure due to a foreign substance being left between the rear contact 13*b*1 and the plug contact section 3*a*, thereby achieving a socket terminal having high connection reliability.

As described above, according to the plug connector 1 of the present embodiment, the relay terminal 8 that switches the short circuit connection is provided separately from the first connection terminal 7A and the second connection terminal 7B. Accordingly, the conductive connection between the plug terminal 3 and the socket terminals 4A, 4B in the fitted state with the socket connector 2 and the short circuit connection between the first connection terminal 7A and the second connection terminal 7B in the non-fitted state can be switched in a reliable manner. Therefore, in the fitted state, the socket terminals 4A, 4B and the plug terminal 3 can be conductively connected with reliability so that the short circuit connection is opened to ensure a signal connection. Further, in the non-fitted state, the short circuit connection can be ensured, thereby preventing a malfunction of the electric device.

Modification Example of Embodiment:

In the above embodiment, the socket terminals 4A, 4B have the front contact 12*b*1 and the rear contact 13*b*1 as a plurality of contacts with the plug terminal 3, the front contact 12*b*1 wipes over the terminal surface 3*a*1 of the plug contact section 3*a* to remove a foreign substance, and the rear contact 13*b*1 comes into conductive contact with that area. On the other hand, the socket terminals 4A, 4B may have one contact only. This reduces the cost for materials.

In the above embodiment, the open contact 8*b*3 is disposed on the upper side to the plug contact section 3*a* so that the plug contact section 3*a* is in conductive contact with the terminal section 4*e* of the socket terminals 4A, 4B after the conductive contact between the first connection terminal 7A and the first short circuit contact 8*b*2 is disconnected. On the other hand, the open contact 8*b*3 may be disposed on the lower side to the plug contact section 3*a*. In this case, the pressing section 11*e*1 of the socket housing 11 may be extended forward in the insertion direction over the terminal section 4*e* of the socket terminals 4A, 4B so that the pressing section 11*e*1 presses the pressed section 8*b*6 before the terminal section 4*e* comes into conductive contact with the plug contact section 3*a* of the plug terminal 12. Accordingly, the same operation and effect as the above embodiment can be achieved.

What is claimed is:

1. A connector comprising:

a first connection terminal and a second connection terminal which come into conductive contact with a connection target;

a relay terminal which comes into contact with the first connection terminal and the second connection terminal; and a housing having an insertion port for the connection target, wherein the relay terminal includes a switch contact piece which comes into contact with the first connection terminal, the switch contact piece includes a short circuit contact which comes into contact with the first connection terminal and an open contact which is displaced when coming into contact with the connection target inserted in the housing so that the short circuit contact is displaced with displacement of the open contact in a direction away from the first connection terminal to release the short circuit connection, and the open contact is located close to the insertion port of the housing than the first connection terminal so that the open contact comes into contact with the connection target before the first connection terminal comes into contact.

2. The connector according to claim 1, wherein the relay terminal includes a short circuit contact piece which comes into contact with the second connection terminal.

3. The connector according to claim 2, wherein relay terminal includes a fixed base for the housing, and the short circuit contact piece is formed by cutting out a metal piece which forms the fixed base.

4. The connector according to claim 1, wherein the switch contact piece is formed as a single elastic piece, the open contact is disposed on a distal end side of the switch contact piece, and the short circuit contact is formed between the distal end side and the proximal end side.

5. The connector according to claim 4, wherein the switch contact piece includes a bending section which serves as a displacement support of the open contact and the short circuit contact on the proximal end side.

6. The connector according to claim 1, wherein the housing houses the relay terminal and includes a guide pole that guides insertion of the connection target into the housing.

* * * * *